US006929893B2

(12) United States Patent
Yoshino et al.

(10) Patent No.: US 6,929,893 B2
(45) Date of Patent: Aug. 16, 2005

(54) ELECTROSTATIC IMAGE DRY TONER COMPOSITION, DEVELOPER FOR DEVELOPING ELECTROSTATIC LATENT IMAGE AND IMAGE FORMING METHOD

(75) Inventors: Susumu Yoshino, Minamiashigara (JP); Motoko Sakai, Minamiashigara (JP); Yoshifumi Iida, Minamiashigara (JP); Seiichi Takagi, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 175 days.

(21) Appl. No.: 10/409,447

(22) Filed: Apr. 9, 2003

(65) Prior Publication Data

US 2004/0058258 A1 Mar. 25, 2004

(30) Foreign Application Priority Data

Sep. 19, 2002 (JP) ..... 2002-273480
Sep. 19, 2002 (JP) ..... 2002-273808
Sep. 19, 2002 (JP) ..... 2002-273809

(51) Int. Cl.[7] ..... G03G 9/09

(52) U.S. Cl. ..... 430/108.1; 430/108.3; 430/108.4; 430/108.6; 430/108.8

(58) Field of Search ..... 430/108.1, 108.3, 430/108.4, 108.6, 108.8

(56) References Cited

U.S. PATENT DOCUMENTS 6,087,059 A * 7/2000 Duggan et al. ..... 430/108.22
6,379,856 B2 * 4/2002 Sokol et al. ..... 430/108.24
2002/0187413 A1 * 12/2002 Watanabe et al. ..... 430/108.8

FOREIGN PATENT DOCUMENTS

JP A 56-125751 10/1981
JP A 60-136775 7/1985
JP A 60-198556 10/1985

(Continued)

*Primary Examiner*—Mark A. Chapman
(74) *Attorney, Agent, or Firm*—Oliff & Berridge, PLC

(57) ABSTRACT

An electrostatic image dry toner composition comprising a binding resin, a colorant, a releasing agent, and two or more kinds of inorganic oxide powders having different volume average primary particle diameters. A surface of at least one kind of the inorganic oxide powders is covered with a coating material selected from the group of 1) a fatty acid metal salt, 2) a wax having a melting point of 40° C. or higher, and 3) a resin having a glass transition temperature of 40° C. or higher.

15 Claims, 2 Drawing Sheets

U.S. PATENT DOCUMENTS

| | | |
|---|---|---|
| JP | A 61-231562 | 10/1986 |
| JP | A 61-231563 | 10/1986 |
| JP | A 62-103675 | 5/1987 |
| JP | A 62-184469 | 8/1987 |
| JP | A 62-267766 | 11/1987 |
| JP | A 64-9467 | 1/1989 |
| JP | A 1-133065 | 5/1989 |
| JP | A 2-89064 | 3/1990 |
| JP | A 2-100059 | 4/1990 |
| JP | A 2-132459 | 5/1990 |
| JP | A 2-161466 | 6/1990 |
| JP | A 3-100661 | 4/1991 |
| JP | A 3-122660 | 5/1991 |
| JP | A 3-122661 | 5/1991 |
| JP | A 3-229265 | 10/1991 |
| JP | A 3-260659 | 11/1991 |
| JP | A 4-452 | 1/1992 |
| JP | A 4-40471 | 2/1992 |
| JP | A 4-335649 | 11/1992 |
| JP | A 5-66607 | 3/1993 |
| JP | A 5-94113 | 4/1993 |
| JP | A 5-165250 | 7/1993 |
| JP | A 6-161145 | 6/1994 |
| JP | A 6-266152 | 9/1994 |
| JP | A 6-308759 | 11/1994 |
| JP | A 7-28276 | 1/1995 |
| JP | A 7-84398 | 3/1995 |
| JP | A 7-120086 | 5/1995 |
| JP | A 8-44220 | 2/1996 |
| JP | A 8-115007 | 5/1996 |
| JP | A 9-319134 | 12/1997 |
| JP | A 10-161342 | 6/1998 |
| JP | A 10-186723 | 7/1998 |
| JP | A 10-213977 | 8/1998 |
| JP | A 10-312089 | 11/1998 |

* cited by examiner

ELECTROSTATIC IMAGE DRY TONER COMPOSITION, DEVELOPER FOR DEVELOPING ELECTROSTATIC LATENT IMAGE AND IMAGE FORMING METHOD

BACKGROUND OF THE INVENTION

1. Field of the Invention

The present invention relates to a toner, a developer and an image forming method used for developing an electrostatic latent image in electrophotography and electrostatic recording method.

2. Description of the Related Art

In electrophotography, an image is obtained by developing an electrostatic latent image formed on a latent image holding member (photosensitive member) into a toner image with a toner composition containing a colorant (hereinafter, simply referred to as "toner" in some cases), transferring the resulting toner image onto a transferring member, and fixing this with a heat roll and, on the other hand, the latent image holding member is cleaned for forming an electrostatic latent image again. A dry developer used for such the electrophotography is roughly classified into a one-component developer using alone a toner in which a colorant and the like are incorporated into a binding resin, and a two-component developer in which a carrier is mixed into the toner.

Since late in 1980's, in the market of electrophotography, miniaturization and high performance were strongly demanded as keywords of digitalization and, in particular, regarding full color image, high image quality close to that of high-grade printing and silver salt photography has been desired.

As means for attaining high image quality, digitalization is indispensable, and the performance of digitalization regarding such the image quality includes the ability to perform complicated image processing at a high speed. Thereby, it becomes possible to control a letter image and a photography image separately, and the reproductivity of quality of both images has been greatly improved as compared with the analog technique. In particular, regarding photographic images, the enabling of gradation correction and color correction has been important, and digitalization is advantageous as compared with analog in terms of gradation properties, fineness, visibility, color reproduction and graininess. However, on the other hand, as image output, it is necessary to faithfully make an image from a latent image produced by an optical system, a particle diameter of a toner grows increasingly smaller, and the activities aiming at faithful reproduction are being accelerated. However, mere reduction in a toner diameter hardly affords high image quality stably, and improvement in the fundamental properties in development, transference and fixing properties have become more important.

In particular, in a color image, three-color or four-color toners are overlapped to form an image. For this reason, when any of toners exhibits different properties from original ones or different performance from that of other colors in a viewpoint of development, transference and fixing, reduction in color reproduction, deterioration of the graininess, and deterioration of image quality such a irregular color are caused. In order to maintain a stable high quality image in its original state even over time, how the property of each toner is stably controlled is important.

For example, in the prior art, a toner having an average particle diameter of 7 to 14 $\mu$m was proposed (see Japanese Patent Application Laid-Open (JP-A) No. 62-103675). In addition, regarding a particle size distribution, JP-A No. 2-132459 proposed a toner having a sharp particle size distribution.

Generally, as a particle size becomes smaller, the electrifying property of a developer tends to decline as more images are printed, and a life of the developer is shortened. This is because when a particle size becomes smaller, a surface area of a toner per unit becomes larger and an amount of an additive added to the surface thereof becomes also larger, but these allow toner components and additives to easily stain the carrier surface. Therefore, a sharper particle size distribution of a toner is better, but there is a limit due to a problem of manufacturing and the cost. The toner described in the above-mentioned Japanese Patent Applications Laid-open also included a toner whose particle size distribution was broad in the large particle diameter range or in the small particle diameter range. It was thus difficult to obtain a high quality image.

Further, there was a problem that since a fine powder having a small particle diameter was contained, a developer's life was short (for example, see JP-A No. 2-132459).

For the purpose of improving a developer's life, a metal oxide with a chain-like polymer grafted (for example, see JP-A No. 64-9467), and an electrically conductive fine particle covered with a resin (for example, see JP-A No. 4-335649) were proposed. However, uniformity of surface treatment was low, and although a developer's life was maintained to a certain extent, the improvement was not sufficient.

In addition, in order to satisfy both of improvement in the flowability and the environmental stability of electrification, for example, JP-A No. 60-136775 tried to use hydrophobic titania and hydrophobic silica jointly. However, when a color toner having a small diameter was used, mere mixing of them resulted in a worse transferring property, and a stable image could not be obtained.

In addition, in order to satisfy both of improvement in the flowability and the environmental stability of electrification, for example, JP-A No. 10-186723 tried to use a hydrophobic titanium series compound and hydrophobic silica having different particle diameters jointly. However, when a color toner having a small particle diameter was used, mere mixing of them maintained a life of a developer to a certain extent, but the improvement was not sufficient, and a stable image could not be obtained for a long period of time.

On the other hand, JP-A No. 10-312089 reports that a toner is stirred in a developing unit, the fine structure of the toner surface is easily changed, and the transferring property is greatly changed.

Recently, for the purpose of miniaturizing an apparatus from a viewpoint of space saving, decreasing toner wastes from a viewpoint of environmental protection, and prolonging a life of a latent image holding member, a cleanerless system is proposed. In the cleanerless system a cleaning system is omitted, a toner remaining on the surface of photosensitive drum after transference is dispersed with a brush touching the surface of the photosensitive drum, the dispersed toner is recovered in a developing unit at the same time of development (for example, see JP-A No. 5-94113).

Generally, when a remaining toner is recovered at the same time of development like this, the recovered toner and other toner have different electrifying properties, such a problem may occur that the recovered toner is not developed and is accumulated in a developing unit. Therefore, it becomes necessary to further increase the transfer efficiency and to minimize the amount of a toner to be recovered.

In addition, in order to improve the flowability, the electrifying property and the transferring property, for example, JP-A No. 62-184469 proposed to render a shape of a toner approach a spherical shape.

However, rendering a toner a spherical shape may easily cause the following problems. A conveyance amount controlling plate is provided on a developing unit for controlling an amount of a developer to be conveyed constant, and the gap between a developer holding member and a conveyance amount controlling plate is changed so as to control the conveyed amount of a developer. However, when a spherical toner is used, the flowability of a developer is increased and at the same time, a hardening bulk density is increased. As a result, there occurs the phenomenon that, a developer is accumulated at a conveyance regulating site, and a conveyance amount becomes unstable. By controlling the surface roughness on a developer holding member and, at the same time, narrowing the gap between a controlling plate and a developer holding member, a conveyance amount may be improved. However, the packing property due to accumulation of a developer is strengthened increasingly and, accordingly, a stress applied to a toner becomes stronger. It is confirmed that there is such a problem in that the above phenomena make a fine structure change of the toner surface, particularly embedding or peeling, of an external additive occur easily, and that the developing property and the transferring property are greatly changed as compared with an initial stage.

In order to solve these problems, JP-A No. 6-308759 reports that a spherical toner and a non-spherical toner are combined to suppress the packing property and high image quality can be attained. However, although this is effective in suppressing the packing property, a non-spherical toner easily remains as the transference residue, and the high transference efficacy can not be attained. In addition, when development and recovery are performed at the same time, since a non-spherical toner which is the transference residue is recovered, a ratio of a non-spherical toner is increased, causing a problem of further decline in the transference efficacy.

In addition, in order to improve the developing property, the transference property and the cleaning property of spherical toner, JP-A No. 3-100661 discloses that two kinds of inorganic fine particles having different particle diameters of a particle having a volume average primary particle diameter of 5 $\mu$m or more and less than 20 $\mu$m and a particle having a volume average primary particle diameter of n 20 $\mu$m or more and 40 $\mu$m or less are used jointly, and they are added at specified amounts. Although this can afford the high developing property, transferring and cleaning property at an initial stage, since a force applied to a toner can not be reduced over time in any cases, embedding or peeling of an external additive easily occurs, greatly changing the developing property and the transferring property as compared with those in the initial stage.

On the other hand, against such a stress, it is disclosed that the use of an inorganic fine particle of a large particle diameter is effective for suppressing embedding of an external additive into a toner (for example, see JP-A Nos. 7-28276, 9-319134 and 10-312089). However, since an inorganic fine particle has a large specific gravity, when a size of an external additive particle is increased, by the stirring stress in a developing unit peeling of an external additive or the like becomes inevitable. In addition, since an inorganic fine particle does not exhibit a completely spherical shape, when attached to the toner surface, it is difficult to control standing of an external agent constant. By this, scattering occurs in a microscopic surface convex shape which functions as a spacer, and a stress is selectively applied to a convex part and, therefore, embedding or peeling of an external additive is further accelerated. This method is not sufficient either.

In addition, JP-A No. 6-266152 discloses the technique of adding an organic fine particle of 50 to 200 nm to a toner in order to effectively manifest the spacer function. By using a spherical organic fine particle, it is possible to manifest the spacer function effective at an initial stage. Embedding or peeling of an organic fine particle hardly occurs against a stress over time. However, since an organic fine particle itself is deformed, it is difficult to stably manifest the high spacer function. There is an idea to obtain the spacer effect by attaching a large amount of organic fine particles on the toner surface or using organic fine particles having a large particle diameter. However, according to this idea, the property of an organic fine particle is greatly reflected. That is, there arises the influence on the powder property such as inhibition of the flowability of a toner with an inorganic fine particle added thereto and deterioration of thermal flocculation. An organic fine particle itself also has the electrification imparting ability and this causes an influence on electrification and development such as a decline in a freedom degree of control from a viewpoint of electrification.

Recently, colorization, particularly on demand printing is highly required. And, for responding to high speed copying, JP-A No. 8-115007 reports a method of forming a multi-colored image on a transferring belt, and transferring and fixing the multi-colored image on an image fixing member at once. Transference is repeated two times: the primary transference comprising of a step of transferring from a photosensitive member onto a transferring belt and secondary transference comprising of a step of transferring from a transferring belt onto a transferring member. The technique of improving the transferring efficacy thus becomes increasingly important. In the secondary transference in particular it is imperative to control the electrification, development and transferring properties in order to reduce the influence thereof, since a multi-colored image is transferred at once, and the properties of recording member (e.g. thickness and the surface property in the case of a paper) are variously changed.

In addition, in order to reduce consumed power and space and obtain a high quality image, the technique of transferring each color onto an intermediate transferring member and fixing it at the same time with transference onto a transferring member is disclosed (for example, JP-A Nos. 10-213977 and 8-44220). Herein, the importance lies in the necessity that a transferring belt has both of the transferring function and fixing function. That is, since it is necessary to improve the transferring property in the cooled state at a primary transference part and transmit the heat instantaneously at a secondary transference and fixing part, as a belt, a thin belt having the high thermal resistance is used. Here, since the transferring efficacy can not be controlled extremely high and a high pressure can not be applied at fixing, the function of adaptation is required for a belt at low pressure fixing. In addition, since the belt surface also has the transferring function, it is important to minimize toner contamination at fixing and scratch due to an external additive.

On the other hand, there is proposed a method of faithfully reproducing high image quality, in particular half tone, solid black and letters by controlling volume specific resistance of a carrier (for example, see JP-A Nos. 56-125751, 62-267766 and Japanese Patent Application Publication (JP-B) No. 7-120086). In any of these methods, resistance is adjusted by a kind and a covering amount of a carrier-covering layer. Although aimed volume specific resistance is obtained and high image quality is manifested at an initial stage, peeling of a carrier-covering layer or the like occurs by a stress in a developing unit, and volume specific resistance is greatly changed. Therefore, it is difficult to manifest high image quality over a long time.

On the other hand, a method of adjusting volume specific resistance by adding carbon black to a carrier-covering layer is proposed by JP-A No. 4-40471.

Although change in volume specific resistance by peeling of a covering layer is suppressed by this method, an external additive added to a toner or toner components attach to a carrier, which changes volume specific resistance of a carrier, and, therefore it is difficult to manifest high image quality over a long time as in the aforementioned carrier.

By the way, since, generally, as a particle size becomes smaller, the flowability is deteriorated, or a surface area of a toner per unit weight increases, an amount of a fine particle called external additive to be added to the toner surface increases. Usually, as this fine particle, an inorganic fine powder or an organic fine particle having high Tg or the cross-linking property is used in order to improve the aforementioned flowability, the electrifying property and the transferring property. The present inventors intensively studied and, as a result, found that when an amount of an external additive to be added is increased by every miniaturization in a diameter of a toner, fixing property is deteriorated.

As a method of fixing a toner image, there is a heating fixing method using a heating roller or a heating film. Currently, a heating roller method that has better thermal efficiency and that high speed fixing ability is widely used. However, a heating fixing method using a heating film (belt fixing, film fixing) has been being adopted due to its merits such as a short waiting time from switch on of electric source to ready to use and a small heat capacity that enables reduction in power consumption. In addition, in fixing of a color fixing, since the surface of a heating fixing member and a toner image in the molten state are contacted under pressure, and a part of the toner image is attached to the surface of a heating member, whereby, an attached toner is re-transferred to prevent contamination of a copied image, so-called offset phenomenon, a method of supplying a releasing oil (releasing liquid such as silicone oil etc.) is adopted. However, although this method is extremely effective to prevent the offset phenomenon of a toner, this releasing oil (offset preventing liquid) produces unpleasant odor when heated and vaporized, and an apparatus for supplying an offset preventing liquid becomes necessary. Therefore, a fixing apparatus without the use of releasing oil is currently being adopted by re-design of a toner resin and a wax resin.

For the purpose of improving the fixing property, a molecular weight of a resin constituting a toner bulk, Tg, and a kind and an amount of a wax are variously studied. For solving such problems, there are proposed a method of limiting the viscosity of a toner (see JP-A Nos. 1-133065, 2-161466, 2-100059 and 3-229265), a method of inclusion of a wax such as a resin having the releasing property (see JP-B No. 52-3304), a method of limiting the melt viscosity of a wax (see JP-A Nos. 3-260659 and 3-122660), a method of limiting a diameter of wax domain and a rate of a wax existing on the toner surface (see JP-A No. 7-84398), a method of limiting a shape of a wax domain (see JP-A No. 6-161145), and the like.

In addition, regarding a heating fixing method using a heating film, there are a variety of proposals from a viewpoint of the more stable fixing property and energy saving. For example, for the purpose of suppressing the offset phenomenon of fixing, JP-A No. 3-122661 proposes a method of limiting the viscosity of a binder resin and a releasing agent constituting a toner.

However, it can not be said that the above method has sufficiently realized the fixing property substantially without using releasing oil. There still remain problems to be solved. Accordingly, a study of toner bulk material has a limit to some extent, and it is difficult to respond to deterioration of fixing due to miniaturization of a diameter of a toner. As a proposal other than a toner bulk, there is proposed a toner wherein an inorganic compound with the surface treated with low-molecular polyethylene is added to the surface of the toner (see JP-A No. 5-165250). However, this proposal does not refer to the fixing property. Moreover, the surface of the treated inorganic compound is not uniformly covered with polyethylene, and a large amount of polyethylene does not cover the surface of an inorganic compound. For this reason, the contamination of the surface of a photosensitive member with polyethylene itself is observed in long term and improvement in the fixing property is insufficient.

A dry developer can be roughly classified into a one-component developer using a toner in which a colorant is dispersed into a binder resin, and a two-component developer in which a carrier is mixed into the toner. In any case, upon copying, an electrostatic latent image formed on a photosensitive member is developed by these developers, and a toner image on the surface of a photosensitive member is transferred and, thereafter, a toner remaining on the surface of a photosensitive member is cleaned. Therefore, it is required that a dry developer satisfies various conditions in a copying step, in particular, in a developing step and a cleaning step. A toner is supplied to developing not as a flocculate but as individual particles. It is thus required that a toner has the sufficient flowability and, at the same time, this flowability or electric properties do not change depending on time or the environment (temperature, humidity). In addition, in a two-component developer, it is required that adhesion of a toner to the carrier surface, so-called toner filming phenomenon does not occur.

Further, upon cleaning, such the cleaning property is required that a remaining toner is easily dropped off from the surface of a photosensitive member and, when used with a cleaning member such as a blade, a web and the like, a photosensitive member is not damaged. In order to satisfy these various requirements, in a dry developer, there are variously proposed a one-component developer or a two-component developer in which an inorganic fine powder such as silica and the like, an organic fine powder such as fatty acid, or a metal salt or a derivative thereof, or a fluorine series resin fine powder is externally added to a toner, and the flowability, the durability or the cleaning property is tried to be improved.

However, among previously proposed additives, although an inorganic compound such as silica, titania, alumina and the like remarkably improves the flowability, there is a problem that a recess or a flaw is easily produced on a surface layer of a photosensitive member by a hard inorganic compound fine powder, and toner adhesion is easily caused at a damaged part. In addition, recently, although utilization of a recycled paper for the purpose of source saving has been increased, there is generally a problem that a recycled paper produces much paper powder, a paper powder enters between a photosensitive member and a blade, and induces deteriorated cleaning such as black streak.

In order to solve these problems, a fatty acid metal salt as an additive is externally added to a toner, or a wax is externally added (for example, see JP-A Nos. 60-198556, 61-231562 and 61-231563). In these cases, a particle diameter of an additive is large as 3 to 20 $\mu$m in all cases and, in order to effectively manifest the effects, it becomes necessary to add at a considerable amount. In addition, although effective initially, there arises a problem that formation of a membrane as a lubricant is not uniform due to unique filming of an additive (lubricant), and white spot, image fading and the like occur in an image.

In addition, as an additive, there are provided a titanium oxide particle treated with a fatty acid metal salt, a titanium oxide fine particle with the surface treated in hydrolyzing a fatty acid compound in an aqueous system, an inorganic compound with the surface treated with a fatty acid metal salt and fine particle titanium oxide obtained by hydrophobilization by surface treatment with fatty acid aluminium (for example, see JP-A Nos. 4-452, 5-66607, 5-165250, 10-161342). By using a fatty acid metal salt in the surface treatment like this, the aforementioned problems derived from a magnitude of a particle diameter of a fatty acid metal salt itself are avoided to some extent. However, no case refers to the uniformity of the surface treatment, and prevention of a flaw on the surface of a photosensitive member is insufficient.

On the other hand, a method of preventing toner filming by externally adding a hydrophobic hard fine powder to a toner, and cutting a photosensitive member by the polishing effect of a hard fine powder is proposed, for example, in JP-A No. 2-89064. However, although this method is effective in suppression of filming, there is a defect that the surface of a photosensitive member is abraded, and a photosensitive member's life is remarkably reduced. At the same time, there is also a defect that a cleaning blade is abraded with a hard fine powder, and a life of a blade is remarkably reduced.

SUMMARY OF THE INVENTION

The present invention was done in view of the aforementioned circumstances in the related art. An object of the invention is to provide an electrostatic image dry toner composition which can satisfy the toner flowability, the electrifying property, the developing property, the transferring property, the cleaning property and the fixing property at the same time and over a long period of time, can prevent a flaw of a latent image holding member from occurring, does not have a blade cleaning step promoting, in particular, abrasion of a latent image holding member, and improves the problem of recovering a transference residue toner at the same time with developing, or of recovering a toner remaining on a latent image holding member using an electrostatic brush, and a developer for developing electrostatic latent images using the same.

Another object of the invention is to provide an image forming method that can perform developing, transference, fixing and oil-less fixing responding to the high image quality requirement.

In order to attain the aforementioned objects, the present inventors intensively studied and, as a result, found that the aforementioned objects can be attained using particular inorganic oxide powder as a toner, which resulted in completion of the invention.

That is, a first aspect of the invention provides an electrostatic image dry toner composition comprising a binding resin, a colorant, a releasing agent, and two or more kinds of inorganic oxide powders having different volume average primary particle diameters, wherein a surface of at least one kind of the inorganic oxide powders is covered with a coating material selected from the group of 1) a fatty acid metal salt, 2) a wax having a melting point of 40° C. or higher, and 3) a resin having a glass transition temperature of 40° C. or higher.

A second aspect of the invention provides a developer for developing electrostatic latent images, the developer comprising: a carrier having, on a surface of a core material, a resin-coating layer in which an electrically conductive material is dispersed in a matrix resin; and a toner composition described in the first aspect.

A third aspect of the invention provides an image forming method of forming an image using an image forming apparatus comprising electrifying means for uniformly electrifying a latent image holding member, latent image forming means for exposing a surface of the electrified latent image holding member with light to form an electrostatic latent image, developing means for developing the electrostatic image into a toner image using the toner composition described in the first aspect, transferring means for transferring the formed toner image onto a recording member, and fixing means for fixing the transferred toner image onto a surface of a recording member.

The image forming apparatus of the third aspect of the invention may further comprise cleaning means for removing a toner remaining on the surface of a latent image holding member after transference. Instead, the image forming apparatus of the third aspect of the invention may further comprise transferring and fixing means for transferring the formed toner image onto an intermediate transferring member, and transferring and fixing the toner image onto a recording member at the same time.

DETAILED DESCRIPTION OF THE INVENTION

Figure 1:
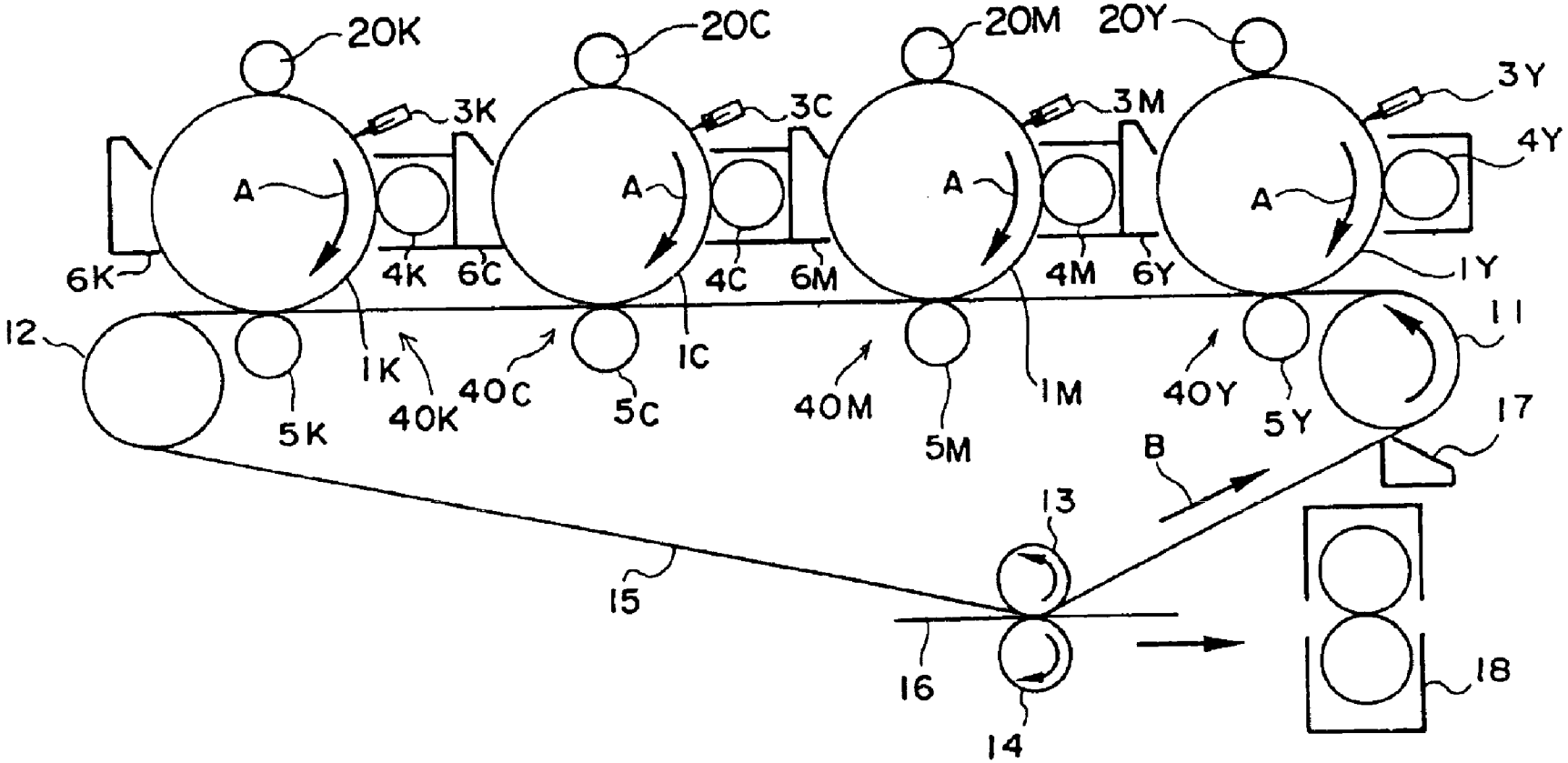
FIG. 1 is a schematic cross-sectional view showing one example of an image forming apparatus used in the present invention.

An electrostatic image dry toner composition of the present invention (hereinafter, simply abbreviated to as "toner composition" or "toner" in some cases) will be explained below.

The electrostatic image dry toner composition of the invention is characterized in that it is an electrostatic image dry toner composition comprising a binding resin, a colorant, a releasing agent, and two or more kinds of inorganic oxide powders having different volume average primary particle diameters, and a surface of at least one kind of the inorganic oxide powder is covered with a coating material selected from the group of 1) a fatty acid metal salt, 2) a wax having a melting point of 40° C. or higher, and 3) a resin having a glass transition temperature of 40° C. or higher.

First, the case where the coating material is 1) a fatty acid metal salt will be explained.

That is the electrostatic image dry toner of the invention comprises two or more kinds of inorganic oxide powders as an external additive, and it is necessary that at least one kind of them is an inorganic oxide powder, the surface of which is covered with a fatty acid metal salt uniformly.

Since the fatty acid metal salt is a low surface energy material, not only the flowability but also the transferring property of a toner having the surface treated with the salt are improved. Further, since a fatty acid metal salt has the stretching property, when the salt is freed from a toner and remains on the surface of a photosensitive member after transference, a fatty acid metal salt covers the surface of a photosensitive member at an extremely small thickness by the mechanical action of a cleaning member such as a cleaning blade which is contacted with a photosensitive member under pressure, or a cleaning brush which contacts with a photosensitive member at a linear velocity, and this covering layer reduces a frictional coefficient of the surface of a photosensitive member. By reduction in a mechanical pressure of a cleaning member due to this covering layer and reduction in a frictional coefficient, an amount of the surface layer of a photosensitive member to be abraded and a flaw can be reduced, and an abrasion life of a photosensitive member can be improved. Uniform covering of the surface of an inorganic oxide powder with a fatty acid metal salt can effectively induce these actions. And, it has been found that, by adopting such the construction, the flowability, the electrifying property, the developing property, the transferring property and the fixing property of a toner can be satisfied at the same time and over a long term.

And, in the invention, it is preferable that an external additive having a smaller volume average primary particle diameter has a volume average primary particle diameter of 5 nm or more and less than 30 nm, and an external additive having a larger volume average primary particle diameter has a volume average primary particle diameter of 30 nm or more and 70 nm or less. By the composition of an external additive set in this range, the flowability, the electrifying property and the transferring property of a small particle diameter toner (average particle diameter of 8 $\mu$m or smaller) at an initial stage of use can be controlled at the better balance.

An amount of an external additive having a smaller average particle diameter to be added is preferably in the range of 0.3 to 3 parts by weight, and more preferably in the range of 0.5 to 1.5 parts by weight based on 100 parts by weight of a toner. When the amount is less than 0.3 part by weight, the sufficient flowability can not be obtained and, when the amount exceeds 3 parts by weight, the toner electrification retaining property is reduced. An amount of an external additive having a larger average particle diameter to be added is preferably in the range of 0.3 to 4 parts by weight, and more preferably in the range of 0.5 to 1.8 parts by weight based on 100 parts by weight of a toner. When the amount is less than 0.3 part by weight, the sufficient transferring property can not be obtained and, when the amount is greater than 4 parts by weight, deterioration of the toner flowability and deterioration of the electrification retaining property are caused in some cases.

Development and transference are influenced by the uniform conveyance property of a developer, a current at transference and the like. However, they are fundamentally steps of separating a toner particle from the constraining force of a carrier carrying a toner particle and adhering the particle to a subject (latent image holding member or recording member) and, therefore, development and transference are also influenced by the balance between the electrostatic attracting force and the adhering force of a toner particle, and an electrification imparting member, or a toner particle and a latent image holding member. Since this step has the direct influence on image quality and, when the efficacy of development and transference is improved, improvement in reliance and saving by cleaning-less can be expected, the higher developing property and transferring property are required in the aforementioned step though controlling this balance is quite difficult. In the invention, since an inorganic fine particle is uniformly covered with a resin, there arises the state where scatter in adhesion to a toner particle is small, and the aforementioned balance is easily realized.

Development and transference occur when F (electrostatic attracting force)>F (adhering force). Therefore, in order to improve the efficacy of development and transference, it is necessary to increase electrostatic attracting force (strengthen the developing and transferring force), or to decrease the adhering force. However, in the case where the developing and transferring forces are strengthen, for example, when the transference electric field is increased, secondary disorder such as occurrence of a reverse-polar toner is easily caused. Therefore, it is more effective to decrease the adhering force.

As the adhering force, there are the Van der Waals force (non-electrostatic adhering force) and the mirror image force due to a charge harbored by a toner particle. There is a difference in level of nearly one order between both forces, and it is construed that a discussion can be made only by considering the Van der Waals force. The Van der Waals force Fv between spherical particles is expressed by the following equation (1):

$$Fv=H\cdot r_1\cdot r_2/6(r_1+r_2)\cdot a^2 \qquad \text{equation (1)}$$

(H: constant, $r_1$, $r_2$: radius of contacting particles, a: distance between particles)

For the purpose of the reduction in the adhering force, by intervening a fine powder having very small r as compared with that of a toner particle between the surfaces of a toner particle and a latent image holding member and the surface of an electrification imparting member, a distance a between respective particles is retained and, further, a contacting area (number of contacting points) is decreased. In order to stably maintain the above effect, it is effective to use, as an inorganic oxide powder, monodisperse spherical silica having a specific gravity of 1.2 to 1.9 and a volume average primary particle diameter of 80 to 300 nm.

By controlling a specific gravity of this monodisperse spherical silica at 1.9 or smaller, peeling from a toner can be suppressed. In addition, by controlling the specific gravity at 1.2 or larger, flocculation and dispersion can be suppressed. In addition, due to monodispersion and spherical shape, the silica is uniformly dispersed on the toner surface, and a stable spacer effect can be obtained.

Definition of the aforementioned monodispersion can be discussed by a standard deviation to an average particle diameter including a flocculate. Regarding a volume average primary particle diameter D50, it is desirable that a standard deviation is D50×0.22 or smaller. Definition of the aforementioned spherical shape can be discussed by a spherical degree of Wadell, and it is desirable that a spherical degree is 0.6 or larger, preferably 0.8 or larger. In addition, the reason for limiting to silica is that a refractive index thereof is around 1.5 and, even when a particle diameter is magnified, there is no influence on reduction in a transparent degree by light scattering, in particular, the PE value (index of light permeability) at projection of image on OHP. Therefore, it is desirable to use it as a color toner.

General fumed silica has a specific gravity of 2.2 and a particle diameter of maximum 50 nm is a limit from a viewpoint of manufacturing. In addition, although a particle diameter as a flocculate can be increased, uniform dispersion and the stable spacer effect can not be obtained. On the other hand, examples of other representative inorganic fine particles include titanium oxide (specific gravity 4.2, refractive index 2.6) alumina (specific gravity 4.0, refractive index 1.8) and zinc oxide (specific gravity 5.6, refractive index 2.0). However, any of them have a high specific gravity and, when a particle diameter is larger than 80 nm effectively manifesting the spacer effect, peeling from a toner is easily caused, a peeled particle is easily transferred to an electrification imparting member or a latent image holding member, and reduction in electrification or defective image quality is caused. In addition, since a refractive index thereof, use of an inorganic material having a large particle diameter is not suitable for formation of a color image.

In the invention, an inorganic oxide powder is added to a toner particle and is mixed therein. Mixing can be performed by the known mixing machine such as a V-type blender, a Henschel mixer and a readygemixer.

In addition, upon this, various additives may be added, if necessary. Examples of these additives include other fluidizing agents, cleaning aids or transference aids such as a polystyrene fine particle, a polymethyl methacrylate fine particle and a polyvinylidene fluoride fine particle.

An amount of monodisperse spherical silica having a specific gravity in the range of 1.2 to 1.9 and a volume average primary particle diameter in the range of 80 to 300 nm to be added is preferably in the range of 0.5 to 5 parts by weight, and more preferably in the range of 1 to 3 parts by weight based on 100 parts by weight of a toner. When the amount is less than 0.5 part by weight, sufficient improvement in the transferring property can not be obtained and, when the amount is more than 5 parts by weight, deterioration of the flowability of a toner and deterioration of the electrifying property can not be avoided.

In addition, as a method of external addition to a toner, two or more kinds of inorganic oxide powders and monodisperse spherical silica having a specific gravity in the range of 1.2 to 1.9 and a volume average primary particle diameter in the range of 80 to 300 nm may be added and mixed at the same time.

In addition, various methods for addition are studied, the higher effect of the invention can be obtained by first mixing monodisperse spherical silica having a specific gravity in the range of 1.2 to 1.9 and a volume average primary particle diameter in the range of 80 to 300 nm, and adding other inorganic oxide powders at weaker shear. In addition, there is no problem when a sieving process is performed after external addition and mixing.

In addition, when a spherical toner is used, the packing property is inevitably increased at a conveyance regulating site in a developing unit and, accordingly, the strong force is applied not only to the toner surface but also to a carrier. Then, it was found that, by dispersing an electrically conductive material in a resin-coating layer of a carrier, even when peeling of a resin-coating layer occurs, the high image quality can be consequently maintained over a long term without greatly changing a volume specific resistance.

Further, upon image formation, in order to remove a toner remaining on a photosensitive member, a blade cleaning method having the high performance stability is generally employed. However, by using a toner of the invention, it becomes possible to recover a toner remaining on the surface of a latent image holding member using an electrostatic brush, and an abrasion life of a latent image holding member can be considerably prolonged.

In addition, by using a toner of the invention, without providing a cleaning system on the surface of a latent image holding member, it becomes possible to obtain the stable development, transferring and fixing performances without selective accumulation of a specific toner even when a remaining toner is recovered into a developing unit again.

Further, by using a toner of the invention, after respective colors were developed on a latent image holding member, respectively, and transferred on a transferring belt, a high quality image could be obtained by transferring and fixing respective colors onto a recording member at once. In addition, it was confirmed at the same time that there is no influence on the PE value which is an index of the permeability at projection of an image on the surface of OHP.

A process for preparing an inorganic oxide powder having the surface covered with a fatty acid metal salt relating to the invention will be described below.

An inorganic oxide powder having the surface covered with a fatty acid metal salt relating to the invention can be obtained by mixing an inorganic oxide powder with alkoxysilane or polysiloxane, covering the particle surface of an inorganic oxide powder with alkoxysilane or polysiloxane and, then, mixing a fatty acid metal salt with an inorganic oxide powder covered with alkoxysilane or polysiloxane.

Covering of the surface of an inorganic oxide powder with alkoxysilane or polysiloxane may be performed by mechanically mixing and stirring an inorganic oxide powder and alkoxysilane or polysiloxane, or mechanically mixing and stirring by spraying alkoxysilane or polysiloxane to an inorganic oxide powder. Almost all amount of added alkoxysilane or polysiloxane covers the particle surface of an inorganic oxide powder.

In addition, a part of alkoxysilane may be covering as an organosilane compound, which is produced from alkoxysilane via a covering step. Even in this case, there is no influence on adhesion of a fatty acid metal salt thereafter.

As an equipment for mixing and stirring an inorganic oxide powder and alkoxysilane or polysiloxane, or mixing and stirring the aforementioned fatty acid metal salt and an inorganic oxide powder, the surface of which is covered with an organosilane compound or polysiloxane produced from alkoxysilane, an apparatus which can apply a shearing force to a powder layer is preferable and, inter alia, an apparatus which can perform shearing, spatula patting and compression at the same time, for example, a wheal-shaped kneader, a ball-type kneader, a blade-type kneader and a roll-type kneader may be used. When the invention is practiced, a wheal-type kneader can be employed more effectively.

Examples of the aforementioned wheal-type kneader include an edge runner (synonymous with "mixmaler", "Sympsonmill" and "sandmill"), multimal, stozmill, wet pan mill, conermill, ringmaler and the like, preferably edge runner, multimal, stozmill, wet pan mill, and ringmaler, more preferably edge runner. Examples of the aforementioned ball-type kneader include vibration mill. Examples of the aforementioned blade-type kneader include Henschel mixer, planetary mixer and Nauta mixer. Examples of the aforementioned roll-type kneader include extruder.

The conditions at mixing and stirring may be appropriately adjusted so that alkoxysilane or polysiloxane uniformly covers the particle surface of an inorganic oxide powder: a linear load is adjusted in the range of 19.6 to 1960 N/cm (2 to 200 Kg/cm), preferably in the range of 98 to 1470 N/cm (10 to 150 Kg/cm), and more preferably in the range of 147 to 980 N/cm (15 to 100 Kg/cm), and a treating time is adjusted in the range of 5 to 120 minutes, and preferably in the range of 10 to 90 minutes. In addition, the treating conditions of a stirring rate may be appropriately adjusted in the range of 2 to 2000 rpm, preferably in the range of 5 to 1000 rpm, and more preferably in a range to 10 to 800 rpm.

An amount of alkoxysilane or polysiloxane to be added is preferably in the range of 0.15 to 45 parts by weight based on 100 parts by weight of an inorganic oxide powder. When the amount is less than 0.15 part by weight, it is difficult to adhere a fatty acid metal salt at such an amount that an inorganic oxide powder having the surface uniformly covered with the desired fatty acid metal salt is obtained. In addition, since by an amount to be added of 0.15 to 45 parts by weight, 3 to 30 parts by weight of a fatty acid metal salt can be adhere to 100 parts by weight of an inorganic oxide powder, it is meaningless to add an unnecessary amount exceeding 45 parts by weight.

Then, a fatty acid metal salt is added to an inorganic oxide powder covered with alkoxysilane or polysiloxane, and by mixing and stirring the fatty acid metal salt is adhered to alkoxysilane or polysiloxane covering the inorganic oxide powder. If necessary, drying or heating treatment may be further performed.

It is preferable that a fatty acid metal salt is added in portions over a time, particularly over around 5 to 60 minutes. The conditions at mixing and stirring may be appropriately adjusted so that a fatty acid metal salt is uniformly adhered: a linear load is adjusted in the range of 19.6 to 1960 N/cm (2 to 200 Kg/cm), preferably in the range of 98 to 1470 N/cm (10 to 150 kg/cm), more preferably in the range of 147 to 980 N/cm (15 to 100 kg/cm), and a treating time is adjusted in the range of 5 to 120 minutes, preferably in the range of 10 to 90 minutes. In addition, the treating conditions of a stirring rate may be appropriately adjusted in the range of 2 to 2000 rpm, preferably in the range of 5 to 1000 rpm, and more preferably in the range of 10 to 800 rpm.

An amount of a fatty acid metal salt to be added is preferably in the range of 3 to 30 parts by weight, and more preferably in the range of 3 to 15 parts by weight based on 100 parts by weight of an inorganic oxide powder. When an amount of a fatty acid metal salt to be added is outside the aforementioned range, an inorganic oxide powder having the surface uniformly covered with the desired fatty acid metal salt can not be obtained.

Further, it is desirable that the surface of an inorganic oxide powder is covered with a fatty acid metal salt at a thickness of 0.5 to 5 nm so that the aforementioned effects can be stably exerted. Further, it is desirable that a covering rate is 95% or larger.

A heating temperature in a drying or heating step is usually preferably in the range of 40 to 150° C., and more preferably in the range of 60 to 120° C. A treating time is preferably in the range of 10 minutes to 12 hours, and more preferably in the range of 30 minutes to 3 hours.

Alkoxysilane used for covering the inorganic oxide powder ultimately covers the inorganic oxide powder as an organosilane compound produced from alkoxysilane via these steps.

Examples of an inorganic oxide powder used in the invention include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$ and the like, and other known material may be used. In addition, powders which have been treated by hydrophobilization may be used, if necessary. As an inorganic oxide powder having the surface covered with a fatty acid metal salt, $TiO_2$ having comparatively low electric resistance is preferable because it is most effective.

As a fatty acid metal salt for covering an inorganic oxide powder, the previously known salts can be used, such as alminium stearate, calcium laurate, calcium myristate, calcium stearate, zinc laurate, zinc myristate, zinc stearate, magnesium stearate and the like.

In addition, monodisperse spherical silica having a specific gravity in the range of 1.3 to 1.9 and a volume average primary particle diameter in the range of 80 to 300 nm can be obtained by a sol-gel method. Since the silica is prepared by a wet process and without firing, a specific gravity can be controlled lower as compared with a vapor phase oxidizing method. In addition, a specific gravity can be further adjusted by selecting a kind of a hydrophobilizing agent or controlling a treating amount at a hydrophobilization step. A particle diameter can be arbitrarily controlled by a weight ratio, a reaction temperature, a stirring rate and a supplying rate for alkoxysilane, ammonia, alcohol and water at a hydrolyzing and polycondensing step in a sol-gel method.

Monodispersion and spherical shape can be attained by preparation by the present method. More specifically, tetramethoxysilane is added dropwise using aqueous ammonia as a catalyst in the presence of water and alcohol while heating, followed by stirring. Then, the silica sol suspension produced by the reaction is centrifuged to separate into wet silica gel, alcohol and aqueous ammonia. A solvent is added to wet silica gel to convert into the silica sol state again, and a hydrophobilizing agent is added to hydrophobilize the surface of silica. As a hydropholizing agent, general silane compounds can be used. Then, a solvent is removed from this hydrophobilization-treated silica sol, the sol is dried and sieved, whereby, the desired monodisperse silica can be obtained. In addition, the thus obtained silica may be subjected to the treatment again.

As the aforementioned silane compound, water-soluble silane compounds may be used. As such the silane compound, a compound represented by the chemical structural formula $R_aSiX_{4-a}$ (wherein a is an integer of 0 to 3, R represents a hydrogen atom, an organic group such as an alkyl group and an alkenyl group, and X represents a hydrolyzable group such as a chlorine atom, a methoxy group and an ethoxy group) can be used, and any type of chlorosilane, alkoxysilane, silazane and a specialized silylating agent may be used. More specifically, representative examples include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamido, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane. A treating agent in the invention includes, particularly preferably, dimethyldimethoxysilane, hexamethyldisilazane, methyltrimethoxysilane, isobutyltrimethoxysilane and decyltrimethoxysilane.

It is preferable that an electrostatic image dry toner of the invention comprises a binding resin, a colorant and a releasing agent, and a volume average primary particle diameter D50 thereof is in the range of 2 to 8 μm.

In addition, by using a toner having an average shape index SF1 ($ML^2/A$) of 100 to 140, the high developing and transferring properties, and a high quality image can be obtained. A toner used in the invention is not particularly limited by a process of preparation as far as it is in a range satisfying the aforementioned average shape index and particle diameter, and the known method can be used.

The aforementioned average shape index SF1 is obtained as an average of $ML^2/A$ by taking an optical microscope image of a magnetic dispersion-type core scattered on the surface of a slide glass into a Ruzex image analyzing apparatus via a video camera, and measuring a maximum length (ML) and a projected area (A) for 100 or more spherical cores.

As a method for preparing a toner, for example, a kneading and grinding method of kneading, grinding and classifying a binding resin, a colorant, a releasing agent and, further if necessary, a charge control agent, a method of changing a shape of the particle obtained by the kneading and grinding method with the mechanical impact force or the heat energy, an emulsion polymerizing method of emulsion-polymerizing a polymerizable monomer of a binding resin, mixing the formed dispersion, and a dispersion of a colorant, a releasing agent and, if necessary, a charge control agent, and aggregating and heating to melt to obtain a toner particle, a suspension polymerizing method of suspending a solution of a polymerizable monomer for obtaining a binding resin, a colorant, a releasing agent and, if necessary, a charge control agent in an aqueous solvent, followed by suspension, and a dissolving and suspending method of suspending a solution of a binding resin, a colorant, a releasing agent and, further if necessary, a charge control agent in an aqueous solvent, followed by granulation. Alternatively, a preparation method may be performed in which, using a toner obtained by the aforementioned method as a core, a flocculated particle is further adhered and heated to melt to obtain a core/shell structure. Among the above, in particular, a wet process toner for which a spherical toner is easily obtained is preferably used and, further, a toner particle by an emulsion polymerizing and aggregating method is preferably used in that a toner particle having a sharp distribution can be obtained. By using these toner particles by combining the aforementioned external additive, the more stable effects can be obtained.

Examples of a binding resin to be used include homopolymers and copolymers such as styrenes such as styrene, chlorostyrene and the like; mono-olefins such as ethylene, propylene, butylene, isoprene and the like; vinyl esters such as vinyl acetate, vinyl propionate, vinyl benzoate, vinyl butyrate and the like; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate and the like, and vinyl ethers such as vinyl methyl ether, vinyl ethyl ether, vinyl butyl ether and the like; vinyl ketones such as vinyl methyl ketone, vinyl hexyl ketone, vinyl isopropenyl ketone and the like. Particularly, representative examples of a binding resin include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene and the like. Further examples include polyester, polyurethane, epoxy resin, silicone resin, polyamide, modified rosin, paraffin wax and the like.

In addition, representative examples of a colorant for a toner include magnetic powders such as magnetite, ferrite and like, carbon black, aniline blue, calyl blue, chrome yellow, ultramarine blue, Dupont oil red, quinoline blue, methylene blue chloride, phthalocyanine blue, malachite green oxalate, lamp black, rose benagl, C.I. pigment red 48:1. C.I. pigment red 122, C.I. pigment red 57:1, C.I. pigment yellow 97, C.I. pigment yellow 17, C.I. pigment blue 15:1. C.I. pigment blue 15:3 and the like.

Representative examples of a releasing agent include low-molecular polyethylene, low-molecular polypropylene, Fischer Tropsch wax, montan wax, carnauba wax, rice wax, candelilla wax and the like.

In addition, a charge control agent may be added to an electrostatic image dry toner of the invention, if necessary. As a charge control agent, the known ones can be use, and an azo series metal complex compound, a metal complex compound of salicylic acid, a charge control agent of a resin type having a polar group and the like can be used. When a toner is prepared by a wet process, it is preferable that a material which is poorly soluble in water is used in respect of control of the ionic strength and reduction of waster contamination. A toner of the invention may be either of a magnetic toner containing a magnetic material or a non-magnetic toner containing no magnetic material.

<Developer for Developing Electrostatic Latent Image>

A developer for developing electrostatic latent images of the invention is characterized in that it is a developer for developing electrostatic latent images comprising a carrier and a toner composition, the carrier has, on the surface of a core material, a resin-coating layer in which an electrically conductive material is dispersed in a matrix resin, and the toner composition comprises a binding resin, a colorant, a releasing agent, and two or more kinds of inorganic oxide powders having different volume average primary particle diameters, and one kind of them is an inorganic oxide powder having the surface covered with a fatty acid metal salt.

The toner composition is the aforementioned electrostatic image dry toner composition of the invention. On the other hand, as the carrier, a resin-coated carrier having a resin-coating layer in which an electrically conductive material is dispersed and contained in a matrix resin is used.

Examples of the matrix resin are not limited to but include a polyethylene resin, a polypropylene resin, a polystyrene resin, a polyacrylonitrile resin, a polyvinyl acetate resin, a polyvinyl alcohol resin, a polyvinyl butyral resin, a polyvinyl chloride resin, a polyvinyl carbazole resin, a polyvinyl ether resin, a polyvinyl ketone resin, a vinyl chloride-vinyl acetate copolymer, a styrene-acrylic acid copolymer, a straight silicone resin composed of an organosiloxane bond or a modified resin thereof, a fluorine resin, a polyester resin, a polyurethane resin, a polycarbonate resin, a phenol resin, an amino resin, a melamine resin, a benzoguanamine resin, an urea resin, am amido resin and epoxy resin.

In addition, examples of an electrically conductive material are not limited to but include a metal such as gold, solver and copper, and titanium oxide, zinc oxide, barium sulfate, aluminium borate, potassium titanate, tin oxide, carbon black and the like.

The content of the electrically conductive material is preferably in the range of 1 to 50 parts by weight, and more preferably 3 to 20 parts by weight based on 100 parts by weight of a matrix resin.

Examples of a core material for a carrier include a magnetic metal such as iron, nickel, cobalt and the like, a magnetic oxide such as ferrite, magnetite and the like, and a glass bead. In order to adjust a volume specific resistance using a magnetic brushing method, a core material is preferably a magnetic material.

An average particle diameter of a core material is generally in the range of 10 to 500 μm, preferably in the range of 30 to 100 μm in terms of a volume average particle diameter.

Examples of a method of forming a resin-coating layer on the surface of a core material for a carrier include an immersing method of immersing a carrier core material into a covering layer-forming solution containing a matrix resin, an electrically conductive material and a solvent, a spraying method of spraying a covering layer-forming solution to the surface of a carrier core material, a fluidized bed method of spraying a covering layer-forming solution in the state where a carrier core material is floated by the flowing air, and a kneader coater method of mixing a carrier core material and a covering layer-forming solution in a kneader coater, and removing a solvent.

A solvent used in a covering layer-forming solution is not particularly limited as far as it dissolves the matrix resin. For example, aromatic hydrocarbons such as toluene, xylene and the like, ketones such as acetone, methyl ethyl ketone and the like, and ethers such as tetrahydrofuran, dioxane and the like can be used.

In addition, an average membrane thickness of a resin-coating layer is usually in the range of 0.1 to 10 μm and, in the invention, in order to manifest the stable volume specific resistance of a carrier over time, the thickness is preferably in the range of 0.5 to 3 μm.

In order to attain high image quality, a volume specific resistance of a carrier formed as described above is preferably in the range of $10^6$ to $10^{14}$ Ωcm, within the range of $10^3$ to $10^4$ V/cm corresponding to upper and lower limits of a normal developing contrast potential. When a volume specific resistance of a carrier is less than $10^6$ Ωcm, the reproductivity of a fine line is deteriorated, and toner fog to a background due to injection of a charge easily occurs. On the other hand, when a volume specific resistance of a carrier is more than $10^{14}$ Ωcm, reproduction of solid black and half tone is deteriorated. In addition, the amount of carrier that transfers to a photosensitive member increases, and a photosensitive member is easily damaged. In addition, as an electrostatic brush, a resin containing an electrically conductive filler such as carbon black, metal oxide and the like, or a fibrous material having the surface covered with the filler can be used, being not limiting.

A developer for developing electrostatic latent images of the invention is prepared by mixing the toner and the carrier as explained above. A ratio (weight ratio) of mixing the toner and the carrier in the developer is preferably in the range of toner: carrier=1:100 to 20:100, and more preferably in the range of 3:100 to 12:100.

<Image Forming Method>

An image forming method of the invention is an image forming method, which comprises forming an image by using an image forming apparatus comprising electrifying means for uniformly electrifying a latent image holding member, latent image forming means for irradiating the surface of an electrified latent image holding member with light to form an electrostatic latent image, developing means for developing the electrostatic latent image into a toner image using a toner composition, transferring means for transferring the formed toner image onto a recording member, and fixing means for fixing the transferred toner image onto the surface of a recording member, and is characterized in that the toner composition contains a binding resin, a colorant and a releasing agent and, further, two or more kinds of inorganic oxide powders having different volume average primary particle diameters, one kind of them is an inorganic oxide powder having the surface covered with a fatty acid metal salt, and the transferring means is transferring means for developing respective color toners onto a latent image holding member, respectively, transferring onto an intermediate transferring member, and transferring respective color toners onto a recording member at once.

That is, in an image forming method of the invention, as an image forming apparatus for performing image formation, an image forming apparatus comprising a latent image holding member, electrifying means for electrifying the surface of the latent image holding member, latent image forming means for forming a latent image on the surface of the electrified latent image holding member, developing means for developing the electrostatic latent image using a toner composition, and transferring means for transferring the toner image onto a recording member is used. As the toner composition, the aforementioned toner composition of the invention is used. In particular, in full color image formation in an image forming method of the invention, from a viewpoint of the paper generality and high image quality, a color toner image of each color is once transferred and laminated on the surface of an intermediate transferring belt or an intermediate transferring drum as an intermediate transferring member and, thereafter, the laminated color toner images are transferred onto the surface of a recording member such as a paper at once.

In addition, as the image forming apparatus, in particular, an apparatus provided with a plurality of, the latent image holding member, electrifying means for electrifying the surface of the latent image holding member, latent image forming means for forming a latent image on the surface of the electrified latent image holding member, developing means for developing the electrostatic latent image using a toner composition, and transferring means for transferring the toner image onto an intermediate transferring member, that is a tandem-type image forming apparatus is preferably used.

An image forming apparatus used in the invention will be explained below by referring to one example thereof.

FIG. 1 is a schematic cross-sectional view showing one example of an image forming apparatus used in the invention. In this image forming apparatus, as shown in FIG. 1, four developing units 40Y, 40M, 40C, 40K for forming an image of each color of yellow, magenta, cyan and black are arranged in a row (tandem-like) at a certain interval. The respective developing units 40Y, 40M, 40C, 40K are fundamentally constructed similarly except for color of a toner in a developer accommodated therein, and thus a developing unit 40Y for yellow will be explained as a representative.

A developing unit 40Y for yellow is provided with a photosensitive drum as an image carrier (latent image holding member) 1Y, and this photosensitive drum 1Y has an axial line in a direction perpendicular to a paper plane on which the FIG. 1 is drawn, and is rotated along a direction of arrow A at a prescribed process speed by a driving means (not shown). As a photosensitive drum 1Y, for example, an organic photosensitive member having the sensitivity in an infrared region is used.

In addition, a process speed may be switched automatically under the prescribed conditions, or manually. The image forming method of the invention realizes the formation of a high quality image and maintenance of a developer even in such an apparatus that switches processing speed while operation. Herein, examples of "switched automatically under the prescribed conditions" may include a case in which normal mode is switched into low speed mode automatically, in order to obtain a high quality image when image information containing such a high precision image as a photography is inputted.

An upper part of a photosensitive drum 1Y in FIG. 1 is provided with a roll electrifying format electrifier (electrifying means) 20Y, a prescribed voltage is applied to an electrifier 20Y from an electric source (not shown), and the surface of a photosensitive drum 1Y is charged at a prescribed potential (same in electrifiers 20M, 20C, 20K and photosensitive drums 1M, 1C, 1K). In other words the surface of a photosensitive drum 1Y is minus-electrified at a prescribed potential by applying a prescribed voltage to an electrifier 20Y from an electric source (not shown), by discharge produced in a fine gap between an electrifier 20Y and a photosensitive drum 1Y, or by injection of a charge.

A latent image forming means 3Y, which exposes an image on the surface of the photosensitive drum 1Y to form an electrostatic latent image, is arranged at a periphery of the photosensitive drum 1Y on a more downstream side in a direction of rotation of the photosensitive drum 1Y than an electrifier 20Y. Here, due to limited space, an LED array, which realizes the miniaturization of an apparatus, is used as latent image forming means 3Y, but the invention is not limited to it. There is no problem if other latent image forming means such as a laser beam is used.

In addition, a developing unit 4Y for yellow color is arranged at a periphery of a photosensitive drum 1Y on a more downstream side in a direction of rotation of the photosensitive drum 1Y than latent image forming means 3Y, and an electrostatic latent image formed on the surface of the photosensitive drum 1Y becomes visible by a toner of yellow color, to form a toner image on the surface of the photosensitive drum 1Y. In other words, an electrostatic latent image formed on the surface of a photosensitive drum 1Y is visualized on the surface of a photosensitive drum 1Y by reverse development of a toner minus-electrified with a developing unit 4Y and, thus, a toner image is formed.

Below a photosensitive drum 1Y in FIG. 1, an intermediate transferring belt 15 for primarily transferring a toner image formed on the surface of a photosensitive drum 1Y is arranged below four photosensitive drums 1Y, 1M, 1C, 1K, and this intermediate transferring belt 15 is pushed against the surface of a photosensitive drum 1Y by a primary transferring roll 5Y. In addition, an intermediate transferring belt 15 is stretched by a driving means composed of three rolls of a driving roll 11, a support roll 12 and a backup roll 13, and is rotated at a moving rate equivalent to a process speed of a photosensitive drum 1Y in an arrow B direction. And, on the surface of an intermediate transferring belt 15, respective color toner images of magenta, cyan and black in addition to a toner image of yellow primarily transferred as described above are successively primarily transferred and laminated. At full color mode, respective color toner images are multiply transferred in an order of yellow, magenta, cyan and black and, also at single color, two color and three color mode, toner images of necessary colors are transferred alone or multiply in the same order.

In addition, cleaning means 6Y composed of a cleaning blade for cleaning a toner remaining on the surface of photosensitive drum IY and a transferred toner is arranged at a periphery of a photosensitive drum IY on a more downstream side in a direction (arrow A direction) of rotation of a photosensitive drum 1Y than a primary transferring roll 5Y, and a cleaning blade in cleaning means 6Y is attached to the surface of a photosensitive drum 1Y so as to abut against it in a counter direction. After primary transference, a toner remaining on the surface of a photosensitive drum 1Y is scraped off with a cleaning blade of cleaning means 6Y and, thus, the photosensitive drum 1Y is cleaned and is ready for a next image forming step.

A secondary transferring roll 14 is pressure-abutted against a backup roll 13 stretching an intermediate transferring belt 15 via an intermediate transferring belt 15, and a toner image which have been primarily transferred and laminated on the surface of an intermediate transferring belt 15 is electrostatically transferred onto the surface of a transference-receiving member 16 which is supplied from a paper cassette (not shown) to a nip part between a backup roll 13 and a secondary transferring roll 14.

Further, at an outer periphery of an intermediate transferring belt 15, a cleaning member 17 for an intermediate transferring belt is arranged contacting with the surface of the intermediate transferring belt 15, at a position approximately corresponding to the surface of a driving roll 11.

In addition, below a driving roll 11 of an intermediate transferring belt 15 in FIG. 1, there is arranged a fixing equipment 18 for fixing toner images which have been multiply transferred onto the surface of a transference-receiving member 16 by heat and pressure to obtain a permanent image.

In an image forming apparatus used in an image forming method of the invention, respective constituent members are not particularly limited to those recited here. For example, as respective constituent elements such as a latent image holding member, an intermediate transferring member (intermediate transferring belt or intermediate transferring drum), an electrifier and the like, any of the known elements can be adopted.

However, as the aforementioned electrifying means, a roll electrification format electrifier is preferable in that the environmental preserving property due to reduction in ozone occurrence can be realized at a higher dimension.

As cleaning means 6Y, a blade cleaning format is generally preferably used because it is excellent in the performance stability, and that format is also adopted in the aforementioned example. In order to make cleaning of an approximately spherical toner possible, it is desired that the physical property controlling and contacting conditions of a blade are optimized and, at the same time, by using a developer defined in the invention, in particular, a developer containing a toner with an added external additive of a combination of the aforementioned monodisperse spherical silica, and abrasive and a lubricant, it becomes possible to stably clean a toner remaining on the surface of a latent image holding member and, thus, a life due to the resistance to abrasion of a latent image holding member can be considerably prolonged.

An image forming method of the invention is characterized in that the toner composition is a toner composition which contains a binding resin, a colorant and a releasing agent, and contains two or more kinds of inorganic oxide powders having different volume average primary particle diameters, one kind of them being an inorganic oxide powder having the surface covered with a fatty acid metal salt, and has a shape having an average shape index SF1 ($ML^2/A$) of 100 to 140, and the cleaning means recovers a toner remaining on the surface of a latent image holding member using a developing apparatus without rubbing a latent image holding member with a blade.

That is, when the aforementioned toner composition of the invention is used, as the aforementioned cleaning means, an electrostatic brush can be used without rubbing a latent image holding member with a blade. Although a blade cleaning format is generally used due to the high performance stability, by using a toner of the invention, it becomes possible to recover a toner remaining on the surface of a latent image of a carrier using an electrostatic brush, and it becomes possible to considerably prolong an abrasion life (life) of a latent image holding member.

As the electrostatic brush, a fibrous material comprising a resin containing an electrically conductive filler such as metal oxide and the like, or a fibrous material having the surface covered with the aforementioned electrically conductive filler can be used, being not limiting.

In addition, an image forming method of the invention is the aforementioned image forming method and is characterized in that the aforementioned toner composition is a toner composition which contains a binding resin, a colorant and a releasing agent, and contains two or more kinds of inorganic oxide powders having different volume average primary particle diameters, one of them being an inorganic oxide powder having the surface covered with a fatty acid metal salt, and has a shape having an average shape index SF1 ($ML^2/A$) of 100 to 140, and the aforementioned cleaning means recovers a toner remaining on the surface of a latent image holding member using a developing apparatus without rubbing a latent image holding member with a blade.

That is, when the aforementioned toner composition of the invention is used, it becomes possible to recover a toner remaining on the surface of a latent image holding member using a developing apparatus without rubbing a latent image holding member with a blade as the aforementioned cleaning means.

Like this, also when a remaining toner is recovered into a developing unit again, it becomes possible to obtain the stable development, transferring and fixing performances without selective accumulation of a specific toner.

An image forming method of the invention has been explained by using the figure of one example of an image forming apparatus used in an image forming method of the invention, but in the invention, any change and modification can be made to other optional elements by the known findings as far as those elements satisfy the formation of the invention, being not limiting.

The invention is further an image forming method, which comprises forming an image by using an image forming apparatus comprising electrifying means for uniformly electrifying a latent image holding member, latent image forming means for irradiating the surface of an electrified latent image holding member with light to form an electrostatic latent image, developing means for developing the electrostatic latent image into a toner image using a toner composition, and transferring and fixing means for transferring the formed toner image onto an intermediate transferring member, and transferring and fixing the toner image onto a recording member at the same time, and is characterized in that the aforementioned toner composition is a toner composition which contains a binding resin, a colorant and a releasing agent, and contains two or more kinds of inorganic oxide powders having different volume average primary particle diameters, one kind of them being an inorganic fine powder having the surface covered with a fatty acid metal salt, and the aforementioned transferring and fixing means develops respective color toners onto a latent image holding member, respectively, transfers onto an intermediate transferring member and, thereafter, transfers and fixes respective colors onto a recording member at the same time.

That is, when the aforementioned toner composition of the invention is used, a high quality image can be obtained, in particular, in a full color image, even when an image forming apparatus having the aforementioned transferring and fixing means is used to perform image formation.

In an image forming method of the invention, an intermediate transferring member in a transferring step conveys an unfixed toner image to a prescribed toner image transferring and fixing position while retaining the unfixed toner image and, specifically, it is preferable that a two-layered structure composed of a base layer and a surface layer is used. As a base layer, a resin film containing an electrically conductive filler such as carbon black, metal oxide and the like for controlling a resistance low can be used. It is preferable that a film made using a material having the low surface energy for improving the releasing property of a toner is used in a surface layer. It is important that each material is a heat resistant film and, films of PFA (tetrafluoroethylene/perfluoroalkylvinylether copolymer), PTFE (polytetrafluoroethylene), polyimide, silicone and the like can be used, being not limiting.

In an image forming method of the invention, transference and fixation in a transferring fixing means are performed at least by heating, and it is preferable that transference and fixation are performed by heating under pressure. Specifically, for example, it is preferable that prescribed recording member is laid on an intermediate transferring member so as to have a toner image between them, and transference and fixation are performed by one pair of heating and pressing members for performing heating and pressing while piled intermediate transferring member, toner image and recording member are held between members. As a heating and pressing member, a roll in which a heat resistant resilient layer such as a silicone rubber is formed on the surface of a metal roll such as iron, stainless, copper, aluminium and the like and which has a heat source such as a halogen lamp therein can be used. A heating and pressing member is not limited to a roll, but any members can be used as far as they can perform uniform pressing without occurrence of floating and gap between an intermediate transferring member and a recording member. For example, a combination of one heating and pressing roll and one fixed pad, or one set of fixed pads may be used.

Then, the case where the aforementioned coating material is 2) a wax having a melting point of 40° C. or higher will be explained.

That is, the invention is an electrostatic image dry toner composition containing a binding resin, a colorant and a releasing agent, characterized in that the electrostatic chare image dry toner composition contains two or more kinds of inorganic oxide powders having different volume average primary particle diameters, and any one kind of the inorganic oxide powders is an inorganic oxide powder having the surface covered with a wax having a melting point of 40° C. or higher.

In addition, a toner composition of the invention comprises, more precisely, at least a part of a toner body (toner particle) containing a binding resin, a colorant and a releasing agent, and two or more kinds of inorganic oxide powder having different volume average primary particle diameters which are added to the surface of this toner particle as an external additive.

As described above, a toner composition of the invention contains two or more kinds of inorganic oxide powders as an external additive, and it is required that one or more kinds of them are inorganic oxide powders having the surface uniformly covered with a wax having a melting point of 40° C. or higher. Further, it is desirable that a glass transition temperature of the wax is 0° C. or higher.

Since inorganic fine powders added to the surface of a toner are uniformly covered with a wax, wide toner electrification distribution, reverse polar toner and photosensitive member contamination caused by nonuniform covering can be prevented. And since inorganic oxide powders retain a wax also at fixing, deterioration of the fixing property depending on an amount of an inorganic oxide powder to be added can be prevented. Further, the fixing property can be maintained to some extent without adding a wax to a toner particle.

In addition, as the nature of a wax covering an inorganic oxide powder, it is required that a melting point is 40° C. or higher, preferably 80° C. or higher. When a melting point is lower than 40° C., blocking may be caused in storage of a covered inorganic oxide powder, being not preferable. In addition, it is preferable that a melting point is lower than 160° C. When a melting point is 160° C. or higher, melting of a wax at fixing becomes insufficient, and the sufficient fixing property may not be obtained. And, it is found that, by adopting such the construction, the toner flowability, electrifying property, developing property, transferring property and fixing property can be satisfied at the same time and over a long term.

A preferable embodiment of an inorganic oxide powder in the case where the aforementioned coating material is 2) a wax having a melting point of 40° C. or higher is the same as that in the case where the aforementioned coating material is 1) a fatty acid metal salt.

By using a toner of the invention, it has become possible to obtain the stable fixing performance substantially without supplying a releasing oil to the surface of a fixing member (roll, belt etc.). "Substantially" refers to an amount of a releasing oil to be supplied per unit area of a fixing member of 0.1 $\mu l/cm^2$ or smaller.

The invention will be explained in more detail below.

A process for preparing an inorganic oxide powder having the surface covered with a wax relating to the invention will be described. An inorganic oxide powder having the surface covered with a wax relating to the invention can be obtained by mixing an inorganic oxide powder with alkoxysilane or polysiloxane, covering the particle surface of an inorganic oxide powder with alkoxysilane or polysiloxane and, then, mixing a wax with an inorganic oxide powder covered with alkoxysilane or polysiloxane.

Covering of an inorganic oxide powder with alkoxysilane or polysiloxane may be performed by mechanically mixing and stirring an inorganic oxide powder and alkoxysilane or polysiloxane, or by mechanical mixing and stirring while spraying alkoxysilane or polysiloxane to an inorganic oxide powder. An almost all amount of added alkoxysilane or polysiloxane covers the particle surface of an inorganic oxide powder.

In addition, a part of alkoxysilane may be covering as an organosilane compound, which is produced from alkoxysilane via a covering step. Even in this case, there is no influence on adhesion of a fatty acid metal salt thereafter.

As an equipment for mixing and stirring an inorganic oxide powder and alkoxysilane or polysiloxane, or mixing and stirring the aforementioned fatty acid metal salt and an inorganic oxide powder, the surface of which is covered with an organosilane compound or polysiloxane produced from alkoxysilane, an apparatus which can apply a shearing force to a powder layer is preferable and, inter alia, an apparatus which can perform shearing, spatula patting and compression at the same time, for example, a wheal-shaped kneader, a ball-type kneader, a blade-type kneader and a roll-type kneader can be used.

When the invention is practiced, a wheal-type kneader can be employed more effectively. Examples of the aforementioned wheal-type kneader include an edge runner (synonymous with "mixmaler", "Sympsonmill" and "sandmill"), multimal, stozmill, wet pan mill, conermill, ringmaler and the like, preferably edge runner, multimal, stozmill, wet pan mill, and ringmaler, more preferably edge runner. Examples of the aforementioned ball-type kneader include vibration mill. Examples of the aforementioned blade-type kneader include Henschel mixer, planetary mixer and Nauta mixer. Examples of the aforementioned roll-type kneader include extruder.

The conditions at mixing and stirring may be appropriately adjusted so that alkoxysilane or polysiloxane uniformly covers the particle surface of an inorganic oxide powder: a linear load is adjusted in the range of 19.6 to 1960 N/cm (2 to 200 Kg/cm), preferably in the range of 98 to 1470 N/cm (10 to 150 Kg/cm), more preferably in the range of 147 to 980 N/cm (15 to 100 Kg/cm), and a treating time is adjusted in the range of 5 to 120 minutes, preferably in the range of 10 to 90 minutes. In addition, the treating conditions of a stirring rate may be appropriately adjusted in the range of 2 to 2000 rpm, preferably in the range of 5 to 1000 rpm, and more preferably in a range to 10 to 800 rpm.

An amount of alkoxysilane or polysiloxane to be added is preferably in the range of 0.15 to 45 parts by weight based on 100 parts by weight of an inorganic oxide powder. When the amount is less than 0.15 part by weight, it is difficult to adhere a fatty acid metal salt at such an amount that an inorganic oxide powder having the surface uniformly covered with the desired fatty acid metal salt is obtained. In addition, since by an amount to be added of 0.15 to 45 parts by weight, 3 to 30 parts by weight of a fatty acid metal salt can be adhere to 100 parts by weight of an inorganic oxide powder, it is meaningless to add an unnecessary amount exceeding 45 parts by weight.

Then, a wax is added to an inorganic oxide powder covered with alkoxysilane or polysiloxane, and by mixing and stirring them a wax adheres to alkoxysilane or polysiloxane covering an inorganic oxide powder. If necessary, drying or heating treatment may be further performed.

It is preferable that a wax is added in portions over a time, particularly over around 5 to 60 minutes.

The conditions at mixing and stirring may be appropriately adjusted so that a wax is uniformly adhered: a linear load is adjusted in the range of 19.6 to 1960 N/cm (2 to 200 Kg/cm), preferably in the range of 98 to 1470 N/cm (10 to 150 kg/cm), more preferably in the range of 147 to 980 N/cm (15 to 100 kg/cm), and a treating time is adjusted in the range of 5 to 120 minutes, preferably in the range of 10 to 90 minutes. In addition, the treating conditions of a stirring rate may be appropriately adjusted in the range of 2 to 2000 rpm, preferably in the range of 5 to 1000 rpm, and more preferably in the range of 10 to 800 rpm.

An amount of a wax to be added is in the range of 3 to 30 parts by weight, preferably in the range of 3 to 15 parts by weight based on 100 parts by weight of an inorganic oxide powder. When an amount of a wax to be added is outside the aforementioned range, an inorganic oxide powder having the surface uniformly covered with the desired wax can not be obtained in some cases.

Further, it is desirable that the surface of an inorganic oxide powder is covered with a wax at a thickness of 0.5 to 5 nm so that the aforementioned effects can be stably exerted. Further, it is desirable that a covering rate is 90% or larger.

A heating temperature in a drying or heating step is usually preferably in the range of 40 to 150° C., and more preferably in the range of 60 to 120° C. A treating time is preferably in the range of 10 minutes to 12 hours, and more preferably in the range of 30 minutes to 3 hours.

Alkoxysilane used for covering the inorganic oxide powder ultimately covers the inorganic oxide powder as an organosilane compound produced from alkoxysilane via these steps.

Examples of an inorganic oxide powder used in the invention include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$ and the like, and other known powders can be used. In addition, powders that have been hydrophobilized can be used, if necessary. As an inorganic oxide powder having the surface covered with a wax, $TiO_2$ having comparatively low electric resistance is most preferable.

A wax for covering an inorganic oxide powder is not particularly limited as far as it has a melting point of 40° C. or higher, an examples thereof include a paraffin wax and a derivative thereof, a montan wax and a derivative thereof, a microcrystalline wax and a derivative thereof, a Fischer-Tropsche wax and a derivative thereof, a polyolefin wax and a derivative thereof, and the like. The derivative includes an oxide, a polymer with a vinyl monomer, and a graft modified material. Besides, an alcohol series wax, an aliphatic series wax, a vegetable series wax, an animal series wax, a mineral series wax, an ester wax, and acid amide can be utilized.

In addition, the aforementioned monodisperse spherical silica having a specific gravity in the range of 1.3 to 1.9 and a volume average primary particle diameter in the range of 80 to 300 nm can be obtained by a sol-gel method. Since the silica is prepared by a wet process and without firing, a specific gravity can be controlled lower as compared with a vapor phase oxidizing method. In addition, a specific gravity can be further adjusted by selecting a kind of a hydrophobilizing agent or controlling a treating amount at a hydrophobilization step. A particle diameter can be arbitrarily controlled by a weight ratio, a reaction temperature, a stirring rate and a supplying rate for alkoxysilane, ammonia, alcohol and water at a hydrolyzing and polycondensing step in a sol-gel method. Monodispersion and spherical shape can be attained by preparation by the present method. More specifically, tetramethoxysilane is added dropwise using aqueous ammonia as a catalyst in the presence of water and alcohol while heating, followed by stirring. Then, the silica sol suspension produced by the reaction is centrifuged to separate into wet silica gel, alcohol and aqueous ammonia. A solvent is added to wet silica gel to convert into the silica sol state again, and a hydrophobilization treating agent is added to hydrophobilize the surface of silica. As a hydropholizing agent, general silane compounds can be used. Then, a solvent is removed from this hydrophobilization-treated silica sol, the sol is dried and sieved, whereby, the desired monodisperse silica can be obtained. In addition, the thus obtained silica may be subjected to treatment again.

As the aforementioned silane compound, water-soluble silane compounds may be used. As such the silane compound, a compound represented by the chemical structural formula $R_aSiX_{4-a}$ (wherein a is an integer of 0 to 3, R represents a hydrogen atom, an organic group such as an alkyl group and an alkenyl group, and X represents a hydrolyzable group such as a chlorine atom, a methoxy group and an ethoxy group) can be used, and any type of chlorosilane, alkoxysilane, silazane and a specialized silylating agent may be used.

More specifically, representative examples include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamido, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane. A treating agent in the invention includes, particularly preferably, dimethyldimethoxysilane, hexamethyldisilazane, methyltrimethoxysilane, isobutyltrimethoxysilane and decyltrimethoxysilane.

A preferable embodiment of an electrostatic image dry toner in the case where a coating material is 2) a wax having a melting point of 40° C. or higher is the same as that in the case where the coating material is 1) a fatty acid metal salt binding resin.

In addition, a preferable embodiment of a developer for developing electrostatic latent images in the case where a coating material is 2) a wax having a melting point of 40° C. or higher is the same as that in the case where the coating material is 1) a fatty acid metal salt binding resin.

<Image Forming Apparatus>

An image forming method of the invention employs, as an image forming apparatus for performing image formation, an image forming apparatus comprising a latent image holding member, electrifying means for electrifying the surface of the latent image holding member, latent image forming means for forming a latent image on the surface of the electrified latent image holding member, developing means for developing the electrified latent image using a toner composition to form a toner image, and transferring means for transferring the toner image onto a transferring member.

In particular, an apparatus provided with a plurality of, the latent image holding member, the electrifying means for electrifying the surface of the latent image of carrier, the latent image forming means for forming a latent image on the surface of the electrified latent image holding member, the developing means for developing the electrostatic latent image using a toner composition, and the transferring means for transferring the toner image onto a transferring member, that is, a tandem-type image forming apparatus is preferably used.

In particular, in an image forming method of the invention, when a full color image is made, from a viewpoint of the paper generality and high image quality, it is preferable that color toner images of respective colors are once transferred and laminated on the surface of an intermediate transferring member (intermediate transferring belt or intermediate transferring drum), and the laminated color toner images are transferred onto the surface of a recording member such as a paper at once.

An image forming apparatus in the case where a coating material is 2) a wax having a melting point of 40° C. or higher is the same as the image forming apparatus which is explained using the drawings by referring to one example of the case where a coating material is 1) a fatty acid metal salt binding resin.

As an intermediate transferring belt in view of that a toner image is transferred and, at the same time, fixed on a recording member, a belt having a multi-layered structure composed of a base layer and a surface layer can be used.

As a base layer, a resin film containing an electrically conductive filler such as carbon black, metal oxide and the like can be used in order to control a resistance low. It is preferable that, as an uppermost layer, a film made using a material having the low surface energy is used in order to improve the releasing property of a toner. It is important that each material is a heat resistant film, and films of PFA (tetrafluoroethylene/perfluoroalkylvinylether copolymer), PTFE (polytetrafluoroethylene), polyimide, silicone and the like can be used, being not limiting.

As a heating and fixing roll in a fixing equipment and/or a fixing film, the known ones can be used.

In a heating and fixing roll, the surface of a heating roller is formed of a polymer sheet of a silicone rubber and a fluorine resin layer excellent in the releasing property to a toner and of PET (polyethylene terephthalate), PFA (tetrafluoroethylen perfluoroalkylvinylether copolymer), PTFE (polytetrafluoroethylene), polyimide, polyamide and the like which are excellent in the heat resistance, it is desirable that, in a fixing film, a film between a heating body and a pressing member is a heat resistant sheet having a thickness of 1 to 20 $\mu$m, and a material therefor is composed of the aforementioned polymer sheet excellent in the heat resistance, a metal sheet such as aluminium and the like, or a polymer sheet and a metal sheet. More preferably, the surface of a heat resistant sheet has a releasing layer so that releasing becomes smoother. In addition, if necessary, the electrostatic influence on a toner before fixation may be adjusted by controlling an electric resistance.

Then, the case where the aforementioned coating material is 3) a resin component having a glass transition temperature of 40° C. or higher will be explained.

That is, a toner of the invention contains two or more kinds of inorganic oxide powders as an external additive, and it is necessary that one kind of them is an inorganic oxide powder having the surface covered with a resin component having a glass transition temperature of 40° C. or higher.

In a developer composed of a toner and a carrier, the electrifying property of a developer is deteriorated (reduced) by long term use. As a result, there arises the problem of occurrence of background fog (fog) on a transferring member. One of causes is due to contamination of the carrier surface with a toner component containing a toner surface additive by long term use. Although the detail is not clear, the mechanism is considered as follows: the electrification imparting ability of contaminated carrier places is reduced by change from carrier surface components into contaminating components and, when an electric resistance of contaminating components is low, a toner charge is leaked to a carrier side when a toner and a carrier are contacted. Therefore, as means for improving a life of a developer, increase in an electric resistance of an inorganic oxide powder is considered to be effective and, the present inventors intensively studied and found that uniform covering of the surface of an inorganic oxide powder with an insulating resin is effective. Further, it was found that, when covered using a hydrophobic resin, there is little influence of a moisture in the environmental atmosphere and, if uniformly covered, the environmental stability of the electrifying property is improved more. Although the previously known silane coupling treatment, titanate series or aluminate series coupling treatment, or silicone oil treatment can increase an electric resistance of an inorganic oxide fine particle to some extent, there is a limit in uniform covering, and an extent of treating layer thickness. In addition, in the previously proposed covering of the surface with a resin, there are places that are partially not covered and, although an electric resistance can be increased apparently, a life of a developer can not be substantially prolonged.

In addition, as the nature of a resin for covering an inorganic oxide powder, it is required that Tg (glass transition point) is 40° C. or higher, and more preferably 60° C. or higher. When Tg is lower than 40° C., blocking may be caused in storage of a covered inorganic oxide powder, being not preferable. And, it was found that, by adopting such the construction, the toner flowability, electrifying property, developing property, transferring property and fixing property can be satisfied at the same time and over a long term.

A preferable embodiment of an inorganic oxide powder in the where the aforementioned coating material is 3) a resin having a glass transition temperature of 40° C. or higher is the same as that in the case where the aforementioned coating material is 1) a fatty acid metal salt.

The invention will be explained in detail below.

A process for preparing an inorganic oxide powder having the surface covered with a resin component relating to the invention will be described.

An inorganic oxide powder having the surface covered with a resin component relating to the invention can be obtained by mixing an inorganic oxide powder with alkoxysilane or polysiloxane, covering the particle surface of an inorganic oxide powder with alkoxysilane or polysiloxane and, then, mixing with a resin with an inorganic oxide powder covered with alkoxysilane or polysiloxane.

Covering of an inorganic oxide powder with alkoxysilane or polysiloxane may be performed by mechanically mixing and stirring an inorganic oxide powder with alkoxysilane or polysiloxane, or by mechanical mixing and stirring while spraying alkoxysilane or polysiloxane to an inorganic oxide powder. An almost all amount of added alkoxysilane or polysiloxane covers the particle surface of an inorganic oxide powder.

In addition, a part of alkoxysilane for covering may be covering as an organosilane compound, which is produced from alkoxysilane via a covering step. Even in this case, there is no influence on adhesion of a resin thereafter.

As an equipment for mixing and stirring an inorganic oxide powder and alkoxysilane or polysiloxane, or mixing and stirring the aforementioned resin and an inorganic oxide powder, the surface of which is covered with an organosilane compound or polysiloxane produced from alkoxysilane, an apparatus which can apply a shearing force to a powder layer is preferable and, inter alia, an apparatus which can perform shearing, spatula patting and compression at the same time, for example, a wheal-shaped kneader, a ball-type kneader, a blade-type kneader and a roll-type kneader can be used. When the invention is practiced, a wheal-type kneader can be employed more effectively. Examples of the aforementioned wheal-type kneader include an edge runner (synonymous with "mixmaler", "Sympsonmill" and "Sandmill"), multimal, stozmill, wet pan mill, conermill, ringmaler and the like, preferably edge runner, multimal, stozmill, wet pan mill, and ringmaler, more preferably edge runner. Examples of the aforementioned ball-type kneader include vibration mill. Examples of the aforementioned blade-type kneader include Henschel mixer, planetary mixer and Nauta mixer. Examples of the aforementioned roll-type kneader include extruder.

The conditions at mixing and stirring may be appropriately adjusted so that alkoxysilane or polysiloxane uniformly covers the particle surface of an inorganic oxide powder: a linear load is adjusted in the range of 19.6 to 1960 N/cm (2 to 200 Kg/cm), preferably in the range of 98 to 1470 N/cm (10 to 150 Kg/cm), more preferably in the range of 147 to 980 N/cm (15 to 100 Kg/cm), and a treating time is adjusted in the range of 5 to 120 minutes, preferably in the range of 10 to 90 minutes. In addition, the treating conditions of a stirring rate may be appropriately adjusted in the range of 2 to 2000 rpm, preferably in the range of 5 to 1000 rpm, and more preferably in a range to 10 to 800 rpm.

An amount of alkoxysilane or polysiloxane to be added is preferably in the range of 0.15 to 45 parts by weight based on 100 parts by weight of an inorganic oxide powder. When the amount is less than 0.15 part by weight, it is difficult for a resin to adhere at such an amount that an inorganic oxide powder has the surface uniformly covered with the desired resin. Since by an amount to be added of 0.15 to 45 parts by weight, 5 to 30 parts by weight of a resin can be adhered to 100 parts by weight of an inorganic oxide powder, it is meaningless to add an unnecessary amount exceeding 45 parts by weight.

Then, a resin is added to an inorganic oxide powder covered with alkoxysilane or polysiloxane, and by mixing and stirring them a resin adheres to alkoxysilane or polysiloxane covering an inorganic oxide powder. If necessary, drying or heating treatment may be further performed.

It is preferable that a resin is added in portions over a time, particularly over around 5 to 60 minutes.

The conditions at mixing and stirring may be appropriately adjusted so that a resin is uniformly adhered: a linear load is adjusted in the range of 19.6 to 1960 N/cm (2 to 200 Kg/cm), preferably in the range of 98 to 1470 N/cm (10 to 150 kg/cm), more preferably in the range of 147 to 980 N/cm (15 to 100 kg/cm), and a treating time is adjusted in the range of 5 to 120 minutes, preferably in the range of 10 to 90 minutes. In addition, the treating conditions of a stirring rate may be appropriately adjusted in the range of 2 to 2000 rpm, preferably in the range of 5 to 1000 rpm, and more preferably in the range of 10 to 800 rpm.

An amount of a resin to be added is in the range of 3 to 30 parts by weight, preferably in the range of 3 to 15 parts by weight based on 100 parts by weight of an inorganic oxide powder. When an amount of a resin to be added is outside the aforementioned range, an inorganic oxide powder having the surface uniformly covered with the desired resin can not be obtained in some cases. Further, it is desirable that the surface of an inorganic oxide powder is covered with a resin at a thickness of 0.5 to 5 nm so that the aforementioned effects can be stably exerted. Further, it is desirable that the whole surface is covered.

A heating temperature in a drying or heating step is usually preferably in the range of 40 to 150° C., and more preferably in the range of 60 to 120° C. A treating time is preferably in the range of 10 minutes to 12 hours, and more preferably in the range of 30 minutes to 3 hours.

Alkoxysilane used for covering the inorganic oxide powder ultimately covers the inorganic oxide powder as an organosilane compound produced from alkoxysilane via these steps.

Examples of an inorganic oxide powder used in the invention include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$ and the like, and other known powders can be used. In addition, powders that have been hydrophobilized may be used, if necessary. As an inorganic oxide powder having the surface covered with a resin component, $TiO_2$ having comparatively low electric resistance is most preferable.

A resin for covering an inorganic oxide powder is not particularly limited as far as it has Tg of 40° C. or higher, an examples thereof include honopolymers and copolymers of styrenes such as styrene, chlorostyrene and the like, monoolefins such as ethylene, propylene, butylene, isoprene and the like, vinyl esters such as vinyl acetate, vinyl propionate, vinyl benzoate, vinyl butyrate and the like, α-methylene aliphatic monocarboxylic acid esters such as methyl acrylate, ethyl acrylate, butyl acrylate, decyl acrylate, octyl acrylate, phenyl acrylate, methyl methacrylate, ethyl methacrylate, butyl methacrylate, dodecyl methacrylate and the like, vinyl ethers such as vinyl methyl ether, vinyl ethyl ether, vinyl butyl ether, and the like, vinyl ketones such as vinyl methyl ketone, vinyl hexyl ketone, vinyl isopropenyl ketone and the like, and further, a polyester resin, a polyurethane resin, an epoxy resin, a silicone resin, a polyamide resin, a modified rosin resin and the like. In addition, examples of a fluorine-containing resin include homopolymers and copolymers, and copolymers of the monomers and other ethylene series monomers of fluorine-containing monomers such as tetrafluoroethylene, trifluoroethylene, vinylidene fluoride, fluoroethylene, as well as non-cross-linked straight silicone resins comprising an organosiloxane bond, or modified products thereof. Particularly preferable is hydrophobic, and includes a fluorine-containing resin, and a straight silicone resin.

In addition, the aforementioned monodisperse spherical silica having a specific gravity in the range of 1.3 to 1.9 and a volume average primary particle diameter in the range of 80 to 300 nm can be obtained by a sol-gel method. Since the silica is prepared by a wet process and without firing, a specific gravity can be controlled lower as compared with a vapor phase oxidizing method. In addition, a specific gravity can be further adjusted by selecting a kind of a hydrophobilizing agent or controlling a treating amount at a hydrophobilization step. A particle diameter can be arbitrarily controlled by a weight ratio, a reaction temperature, a stirring rate and a supplying rate for alkoxysilane, ammonia, alcohol and water at a hydrolyzing and polycondensing step in a sol-gel method. Monodispersion and spherical shape can be attained by preparation by the present method. More specifically, tetramethoxysilane is added dropwise using aqueous ammonia as a catalyst in the presence of water and alcohol while heating, followed by stirring. Then, the silica sol suspension produced by the reaction is centrifuged to separate into wet silica gel, alcohol and aqueous ammonia. A solvent is added to wet silica gel to convert into the silica sol state again, and a hydrophobilization treating agent is added to hydrophobilize the surface of silica. As a hydropholizing agent, general silane compounds can be used. Then, a solvent is removed from this hydrophobilization-treated silica sol, the sol is dried and sieved, whereby, the desired monodisperse silica can be obtained. In addition, the thus obtained silica may be subjected to treatment again. As the aforementioned silane compound, water-soluble silane compounds may be used. As such the silane compound, a compound represented by the chemical structural formula $R_aSiX_{4-a}$ (wherein a is an integer of 0 to 3, R represents a hydrogen atom, an organic group such as an alkyl group and an alkenyl group, and X represents a hydrolyzable group such as a chlorine atom, a methoxy group and an ethoxy group) can be used, and any type of chlorosilane, alkoxysilane, silazane and a specialized silylating agent may be used.

More specifically, representative examples include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamido, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane. A treating agent in the invention includes, particularly preferably, dimethyldimethoxysilane, hexamethyldisilazane, methyltrimethoxysilane, isobutyltrimethoxysilane and decyltrimethoxysilane.

A preferable embodiment of an electrostatic image dry toner in the case where the coating material is 3) a resin having a glass transition temperature of 40° C. or higher is the same as that in the case where a coating material is 1) a fatty acid metal salt binding resin.

In addition, a preferable embodiment of a developer for developing electrostatic latent images in the case where a coating material is 3) a resin having a glass transition temperature of 40° C. or higher is the same as that in the case where a coating material is 1) a fatty acid metal salt binding resin.

<Image Forming Apparatus>

An image forming method of the invention employs, as an image forming apparatus for performing image formation, an image forming apparatus comprising a latent image holding member, electrifying means for electrifying the surface of a latent image holding member, latent image forming means for forming a latent image on the surface of the electrified latent image holding member, developing means for developing the electrostatic latent image using a toner composition, and transferring means for transferring a toner image formed by development onto a transferring member. In particular, an apparatus provided with a plurality of, the latent image holding member, the electrifying means for electrifying the surface of the latent image holding member, the latent image forming means for forming a latent image on the surface of the electrified latent image holding member, the developing means for developing the electrostatic latent image using a toner composition, and the transferring means for transferring a toner image formed by development onto a transferring member, that is, a tandem-type image forming apparatus is preferably used.

In particular, in an image forming method of the invention, when a full color image is made, from a viewpoint of the paper generality and high image quality, it is preferable that color toner images of respective colors are once transferred and laminated on the surface of an intermediate transferring belt or an intermediate transferring drum as a transferring member, and the laminated color toner images are transferred onto the surface of a recording medium such as a paper and the like at once.

An image forming apparatus in the case where a coating material is 3) a resin having a glass transition temperature of 40° C. or higher is the same as the image forming apparatus which is explained using the drawings by referring to one example in the case where a coating material is 1) a fatty acid metal salt binding resin.

The invention is further a color image forming method, which comprises forming an image by using an image forming apparatus having electrifying means for uniformly electrifying a latent image holding member, latent image forming means for irradiating the electrified latent image holding member with light to form an electrostatic latent image, developing means for developing the electrostatic latent image using a toner composition, and transferring and fixing means for transferring a toner image formed by development onto an intermediate transferring member, and transferring and fixing the toner image onto a recording member at the same time, and is characterized in that the aforementioned toner composition is a toner composition which comprises a binding resin, a colorant, a releasing agent and two or more kinds of inorganic oxide powders having different volume average primary particle diameters, one kind of the inorganic oxide powders being an inorganic oxide powder having the surface covered with a resin component having a glass transition temperature of 40° C. or higher, and the aforementioned transferring and fixing means develops respective color toners onto a latent image holding member, respectively, transfers onto an intermediate transferring member, and transfers and fixes respective colors onto a recording member at once and at the same time.

That is, when the aforementioned toner composition of the invention is used, a high quality image can be obtained, in particular in a full color image, even when image formation is performed by using the aforementioned image forming apparatus having the transferring and fixing means.

In an image forming method of the invention, an intermediate transferring member in a transferring step conveys an unfixed toner image to a prescribed toner image transferring and fixing position while retaining the unfixed toner image and, specifically, it is preferable that a two-layered structure composed of a base layer and a surface layer is used. As a base layer, a resin film containing an electrically conductive filler such as carbon black, metal oxide and the like for controlling a resistance low can be used. It is preferable that a film made using a material having the low surface energy for improving the releasing property of a toner is used in a surface layer. It is important that each material is a heat resistant film and, films of PFA (tetrafluoroethylene/perfluoroalkylvinylether copolymer), PFFE (polytetrafluoroethylene), polyimide, silicone and the like can be used, being not limiting.

In an image forming method of the invention, transference and fixation in a transferring fixing means are performed at least by heating, and it is preferable that transference and fixation are performed by heating under pressure. Specifically, for example, it is preferable that prescribed recording member is laid on an intermediate transferring member so as to have a toner image between them, and transference and fixation are performed by one pair of heating and pressing members for performing heating and pressing while piled intermediate transferring member, toner image and recording member are held between members. As a heating and pressing member, a roll in which a heat resistant resilient layer such as a silicone rubber is formed on the surface of a metal roll such as iron, stainless, copper, aluminium and the like and which has a heat source such as a halogen lamp therein can be used. A heating and pressing member is not limited to a roll, but any members can be used as far as they can perform uniform pressing without occurrence of floating and gap between an intermediate transferring member and a recording member. For example, a combination of one heating and pressing roll and one fixed pad, or one set of fixed pads may be used.

By simultaneously transferring and fixing each color onto a recording member at once after each color toner is developed onto a latent image holding member and transferred onto an intermediate transferring member, a high quality image can be obtained. In addition, in particular, an effect is obtained in that there is no influence on a PE value which is an index of the permeability when a color image is projected on an OHP.

Some embodiments of the present invention are shown as follows.

A first embodiment of the invention provides an electrostatic image dry toner composition comprising a binding resin, a colorant, a releasing agent, and two or more kinds of inorganic oxide powders having different volume average primary particle diameters, wherein a surface of at least one kind of the inorganic oxide powders is covered with a coating material selected from the group of 1) a fatty acid metal salt, 2) a wax having a melting point of 40° C. or higher, and 3) a resin having a glass transition temperature of 40° C. or higher.

A second embodiment of the invention provides an electrostatic image dry toner composition according to the first embodiment, wherein the two or more kinds of inorganic oxide powders having different volume average primary particle diameters are added to a surface of a toner particle.

A third embodiment of the invention provides an electrostatic image dry toner composition according to the first or second embodiment, wherein a volume average primary particle diameter of one of the two or more kinds of inorganic oxide powders having different volume average primary particle diameters is 5 nm or more and less than 30 nm, and a volume average primary particle diameter of another of the two or more kinds of inorganic oxide powders is 30 nm or more and 70 nm or less.

A fourth embodiment of the invention provides an electrostatic image dry toner composition according to any one of the first to third embodiments, wherein the surface of the inorganic oxide powder is covered with a coating material at a thickness of 0.5 to 5 nm.

A fifth embodiment of the invention provides an electrostatic image dry toner composition according to any one of the first to fourth embodiments, wherein the surface of the inorganic oxide powder is covered with at least one of an organosilane compound produced from alkoxysilane and polysiloxane, and further with the coating material.

A sixth embodiment of the invention provides an electrostatic image dry toner composition according to the first embodiment, wherein at least one kind of the two or more inorganic oxide powders having different volume average primary particle diameters is spherical silica having a specific gravity in a range of 1.2 to 1.9 and a volume average primary particle diameter in a range of 80 to 300 nm.

A seventh embodiment of the invention provides an electrostatic image dry toner composition according to any one of the first to sixth embodiments, wherein an average shape index SF1 ($ML^2/A$) of a toner particle of the electrostatic image dry toner composition is in a range of 100 to 140.

An eighth embodiment, the invention provides a developer for developing electrostatic latent images, which comprises a carrier and a toner composition, wherein the carrier is a carrier having, on the surface of a core material, a resin-coating layer in which an electrically conductive material is dispersed in a matrix resin, and the toner composition comprises a binding resin, a colorant, a releasing agent and two or more kinds of inorganic oxide powders having different volume average primary particle diameters, and a surface of at least one kind of the inorganic oxide powders is covered with a coating material selected form the group consisting of 1) a fatty acid metal salt, 2) a wax having a melting point of 40° C. or higher, and 3) a resin having a glass transition temperature of 40° C. or higher.

A ninth embodiment of the invention provides a developer for developing electrostatic latent images according to the eighth embodiment, wherein the two or more kinds of inorganic oxide powders having different volume average primary particle diameters are added to the surface of a toner particle.

A tenth embodiment of the invention provides a developer for developing electrostatic latent images according to the eighth or ninth embodiment, wherein a volume average primary particle diameter of one of the two or more kinds of inorganic oxide powders having different volume average primary particle diameters is 5 nm or more and less than 30 nm, and a volume average primary particle diameter of another of the two or more kinds of inorganic oxide powders is 30 nm or more and 70 nm or less.

An eleventh embodiment of the invention provides a developer for developing electrostatic latent images according to any one of the eighth to tenth embodiments, wherein the surface of the inorganic oxide powder is covered with the coating material at a thickness of 0.5 to 5 nm.

A twelfth embodiment of the invention provides a developer for developing electrostatic latent images according to any one of the eighth to eleventh embodiments, wherein the surface of the inorganic oxide powder is covered with at least one kind of organosilane compound produced from alkoxysilane and polysiloxane, and further with the coating material.

A thirteenth embodiment of the invention provides a developer for developing electrostatic latent images according to any one of the eighth to twelfth embodiments, wherein an average shape index SF1 ($ML^2/A$) of a toner particle of the electrostatic image dry toner composition is in a range of 100 to 140.

A fourteenth embodiment, the invention provides an image forming method forming an image using an image forming apparatus comprising electrifying means for uniformly electrifying a latent image holding member, latent image forming means for exposing the surface of an electrified latent image holding member with light to form an electrostatic latent image, developing means for developing the electrostatic image into a toner image using a toner composition, transferring means for transferring the formed toner image onto a recording member, and fixing means for fixing the transferred toner image onto the surface of a recording member, wherein the toner composition comprises a binding resin, a colorant, a releasing agent, and two or more kinds of inorganic oxide powders having different volume average primary particle diameters, and a surface of at least one kind of the inorganic oxide powders is covered with a coating material selected from the group of 1) a fatty acid metal salt, 2) a wax having a melting point of 40° C. or higher, and 3) a resin having a glass transition temperature of 40° C. or higher.

A fifteenth embodiment of the invention provides an image forming method according to the fourteenth embodiment, wherein the transferring means is transferring means for developing respective color toners onto a latent image holding member, respectively, transferring onto an intermediate transferring member, and transferring respective color toner images onto a recording member at once.

A sixteenth embodiment of the invention provides an image forming method according to the fourteenth embodiment, wherein the fixing means does not sufficiently supply a releasing oil.

A seventeenth embodiment, the invention provides an image forming method forming an image using an image forming apparatus comprising electrifying means for uniformly electrifying a latent image holding member, latent image forming means for exposing the surface of an electrified latent image holding member with light to form an electrostatic latent image, developing means for developing the electrostatic latent image into a toner image using a toner composition, transferring means for transferring the formed toner image onto a recording member, cleaning means for removing a toner remaining on the surface of a latent image holding member after transference, and fixing means for fixing the transferred toner image onto the surface of recording member, wherein the toner composition comprises a binding resin, a colorant, a releasing agent, and two or more kinds of inorganic oxide powders having different volume average primary particle diameters, and a surface of at least one kind of the inorganic oxide powders is covered with a coating material selected from the group of 1) a fatty acid metal salt, 2) a wax having a melting point of 40° C. or higher, and 3) a resin having a glass transition temperature of 40° C. or higher.

An eighteenth embodiment of the invention provides an image forming method according to the seventeenth embodiment, wherein the cleaning means is cleaning means for recovering a toner remaining on the surface of a latent image holding member using an electrostatic brush without rubbing a latent image holding member with a blade.

A nineteenth embodiment of the invention provides an image forming method according to the seventeenth embodiment, wherein the cleaning means is cleaning means for recovering a toner remaining on the surface of a latent image holding member using a developing apparatus without rubbing a latent image holding member with a blade.

A twentieth embodiment, the present invention provides the image forming method according to any one of the seventeenth to nineteenth embodiments, wherein an average shape index SF1 ($ML^2/A$) of a toner particle of the toner composition is in a range of 100 to 140.

A twenty-first embodiment of the invention provides an image forming method forming an image using an image forming apparatus comprising electrifying means for uniformly electrifying a latent image holding member, latent image forming means for exposing the surface of an electrified latent image holding member with light to form an electrostatic latent image, developing means for developing the electrostatic latent image into a toner image using a toner composition, and transferring and fixing means for transferring the formed toner image onto an intermediate transferring member, and transferring and fixing the toner image onto a recording member at the same time, wherein the toner composition comprises a binding resin, a colorant, a releasing agent, and two or more kinds of inorganic oxide powders having different volume average primary particle diameters, and a surface of at least one kind of the inorganic oxide fine particles is covered with a coating material selected from the group of 1) a fatty acid metal salt, 2) a wax having a melting point of 40° C. or higher, 3) a resin having a glass transition temperature of 40° C. or higher, and the transferring and fixing means develops respective color toners on a latent image holding member, respectively, transfers onto an intermediate transferring member and, thereafter, transfers respective color toner images onto a recording member at once and simultaneously fixes respective color toner images on the recording member at the same time.

EXAMPLES

The present invention will be specifically explained by way of Examples, but is not limited to them. In explanation of a toner composition and a carrier, "part" means "part by weight" in all cases unless otherwise indicated.

In preparation of a toner composition, a carrier and an electrostatic latent image developer, each measurement was performed by the following method.

<Measurement of Covering Uniformity of Inorganic Oxide Powder>

A sample particle was dispersed in a two-part liquid mixing type epoxy solution, and allowed to stand overnight to solidify. Then, a section having a thickness of 100 nm was prepared with a microtome. The section was placed on the surface of a copper mesh, and set on a high resolution electron microscope JEM-2010 (manufactured by JEOL. Ltd.), and a photograph was taken at an application voltage of 200 kV and a magnification of 500 thousands. The negative was enlarged to 3 to 10-fold, and then printed.

Based on the photograph printed by the aforementioned procedures, surfaces of cross-sections of ten arbitrarily selected particles were observed, a surface covering state over an entire surface of each particle was assessed, and a covering rate was obtained by the following equation (2).

$$\text{Covering rate} = \text{covering length}/\text{length of entire surface of particle} \times 100(\%) \quad \text{equation (2)}$$

<Measurement of Specific Gravity of External Additive>

A specific gravity of an external additive was measured using a Le Chatelier specific gravity bottle according to 5-2-1 of JIS-K-0061. The procedures are as follows:

(1) About 250 ml of ethyl alcohol is placed in a Le Chatelier specific gravity bottle, and a meniscus is adjusts to a position of a scale.

(2) A specific gravity bottle is immersed in a constant temperature water bath and, when a liquid temperature becomes 20.0±0.2° C., a position of a meniscus is precisely read with a scale of a specific gravity bottle (with precision set to 0.025 ml).

(3) About 100.000 g of a sample is weighed with W representing the weight.

(4) A weighed sample is placed into a specific gravity bottle, and bubbles are removed.

(5) A specific gravity bottle is immersed into a constant temperature water bath and, when a liquid temperature becomes 20.0±0.2° C., a position of a meniscus is precisely read with a scale of a specific gravity bottle (with precision set to 0.025 ml).

(6) A specific gravity is calculated by the following equation (3) and equation (4).

$$D = W/(L2 - L1) \quad \text{equation (3)}$$

$$S = D/0.9982 \quad \text{equation (4)}$$

wherein D is a density of a sample (20° C.) ($g/cm^3$), S is a specific gravity of a sample (20° C.), W is an apparent weight of a sample (g), L1 is reading of a meniscus before a sample is placed into a specific bottle (20° C.)(ml), L2 is a reading of a meniscus after sample is placed into specific gravity bottle (20° C.)(ml), and 0.9982 is a density of water at 20° C. ($g/cm^3$).

<Measurement of Primary Particle Diameter of External Additive and Standard Deviation>

A laser diffraction and scattering-type particle size distribution measuring apparatus (HORIBA LA-910) was used.

<Spherical Degree>

As a spherical degree, a true spherical degree of Wadell was adopted, and a spherical degree was obtained by the following equation (5):

$$\text{Spherical degree}=(\text{surface area of sphere having same volume as that of actual particle})/(\text{surface area of actual particle}) \quad \text{equation (5)}$$

In the aforementioned equation (5), a numerator (surface area of sphere having same volume as that of actual particle) was calculated by an average particle diameter. In addition, as a denominator (surface area of actual particle), the BET specific surface area obtained by using a powder specific surface area measuring apparatus SS-100 type manufactured by Shimazu was used instead.

<Measurement of Resistance>

Figure 2:
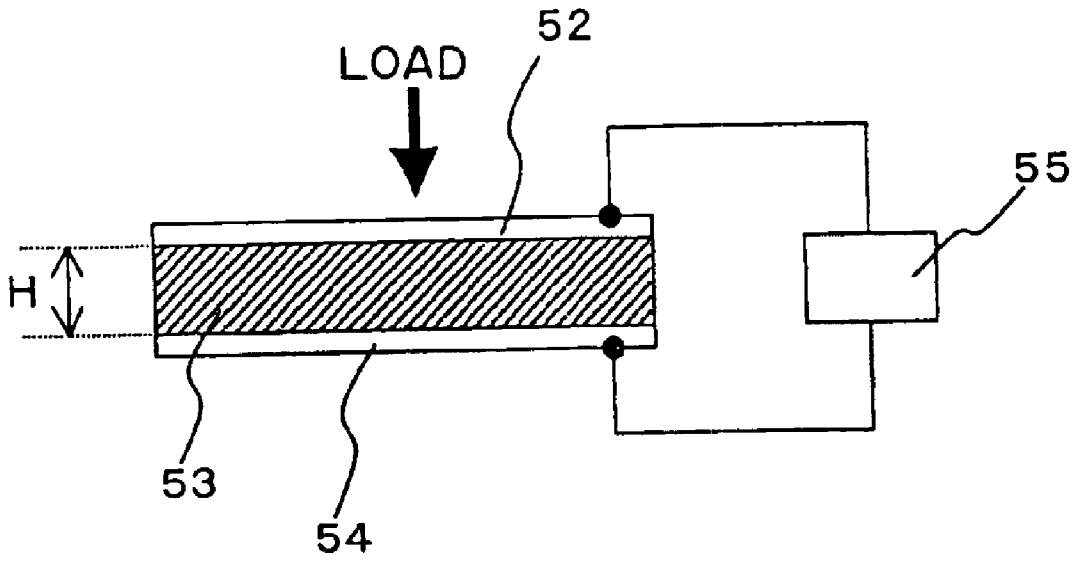
FIG. 2 is a schematic view for explaining a method of measuring a volume specific resistance value of a carrier.

As shown in FIG. 2, by letting a thickness of a measurement sample 53 to be H, a sample was held by a lower electrode 54 and an upper electrode 52, a thickness was measured with a dial gauge while applying a pressure from an upper side, and an electric resistance of a measurement sample 53 was measured with a high voltage resistance meter 55. Specifically, a pressure of $4.9\times10^7$ Pa was applied to a sample of particular titanium oxide with a molding machine, to prepare a measurement disk. Then, the surface of disk was cleaned with a brush, a disk was held by an upper electrode 52 and a lower electrode 54 in a cell, and a thickness was measured with a dial gauge, then, a volume specific resistance was obtained by applying a voltage and reading a current value.

In addition, a carrier sample was filled into a 100ϕ lower electrode 54, an upper electrode 52 was set, a load of 3.43 kg was applied thereon, and a thickness was measured with a dial gauge. Then, a volume specific resistance was obtained by applying a voltage and reading a current value.

<Average Shape Index SF1 ($ML^2/A$)>

In the invention, an average shape index SF1 ($ML^2/A$) of a toner means a value calculated by the following equation (6) and, in the case of a true sphere, $ML^2/A$ becomes 100.

$$ML^2/A=(\text{maximum length})^2\times\pi\times100/(\text{area}\times4) \quad \text{equation (6)}$$

As a specific procedure for obtaining an average shape index, a toner image is taken from an optical microscope into an image analyzing apparatus (LUZEX III, manufactured by Nireco Corporation), a sphere-equivalent diameter is measured and, from a maximum length and an area, a value of $ML^2/A$ in the above equation is obtained for individual particles.

<Measurement of Electrification Amount>

An electrification amount at high temperature and high humidity and at low temperature and low humidity was measured in the following manner. Both a toner composition and a carrier were left in each of a high temperature and high humidity atmosphere (30° C., 90% RH) and a low temperature and a low humidity atmosphere (5° C., 10% RH) for 24 hours. The toner composition and the carrier were taken into a glass bottle with a lid so that a toner concentration became 5% by weight. Tabler mixing was performed in the respective atmospheres, followed by measurement of the stirred developer under the conditions of 25° C. and 55% RH with a TB200 manufactured by Toshiba Corporation.

In addition, an electrification amount in an actual equipment assessment test was measured by taking a developer on a magsleeve in a developing unit, followed by measurement under the conditions of 25° C. and 55% RH with a TB200 manufactured by Toshiba Corporation as described above.

<Solid Area Density>

A solid area density was measured using X-Rite404A (X-Rite).

External additives were prepared as follows:

<Preparation of Fatty Acid Metal Salt-covered Inorganic Oxide Powder (A)>

3,000 parts by weight of a titanium oxide fine powder MT-150A (particle shape: rice particulate, BET specific surface area: 67.5 $m^2/g$, volume average primary particle diameter: 20 nm) was placed into an edge runner "MPUV-2 type" (trade name, manufactured by Matsumoto Chuzotekkosho K.K.), a methyltriethoxysilane solution obtained by diluting 50 parts by weight of methyltriethoxysilane (trade name: TSL8123: manufactured by GE Toshiba Silicones) with 200 parts by weight of ethanol was added to the aforementioned titanium oxide fine powder while operating the edge runner, and mixing and stirring were performed.

Then, 200 parts by weight of a zinc stearate powder was added over 10 minutes while operating the edge runner, mixing and stirring were performed, and zinc stearate was adhered onto a methyltriethoxysilane covering, which was subjected to heat treatment at 105° C. for 60 minutes using drying, to obtain a fatty acid metal salt/covered inorganic oxide powder (A).

A volume average primary particle diameter of the fine powder was 23 nm and, as a result of observation of the covering state, a covering thickness was in the range of 1.0 to 2.0 nm, and 100% of the surface of a fine powder was covered.

<Preparation of Fatty Acid Metal Salt-covered Inorganic Oxide Powder (B)>

3,000 parts by weight of a titanium oxide fine powder TAF-1500 (particle shape: undefined, BET specific surface area: 55.0 $m^2/g$, volume average primary particle diameter: 20 nm, manufactured by Fuji Titanium Industry Co., Ltd.) was placed into an edge runner "MPUV-2 type" (trade name, manufactured by Matsumoto Chuzotekkosho K.K.), a methyltriethoxysilane solution obtained by diluting 50 parts by weight of methyltriethoxysilane (trade name: TSL8213: manufactured by GE Toshiba Silicones) with 200 parts by weight of ethanol was added to the aforementioned titanium oxide fine powder while operating the edge runner, and mixing and stirring were performed.

Then, 100 parts by weight of calcium stearate was added over 10 minutes while operating the edge runner, mixing and stirring were performed, and calcium stearate was adhered to the surface covered with methyltriethoxysilane, which was subjected to heat treatment at 105° C. for 60 minutes, to obtain a fatty metal salt-covered inorganic oxide powder (B).

A volume average primary particle diameter of the fine powder was 22 nm and, as a result of observation of the covered state, a covering thickness was in the range of 0.5 to 1.5 nm, and 100% of the surface of fine powder was covered.

<Preparation of Fatty Acid Metal Salt-covered Inorganic Oxide Powder (C)>

1500 parts by weight of silicon oxide fine powder A 200 (particle shape: undefined, BET specific surface area: 190 $m^2/g$, volume average primary particle diameter: 12 nm) was placed into an edge runner "MPUV-2 type" (trade name, manufactured by Matsumoto Chuzotekkosho K.K.), a methyltriethoxysilane solution obtained by diluting 50 parts by weight of methyltriethoxysilane (trade name: TSL8123:

manufactured by GE Toshiba Silicones) with 200 parts by weight of ethanol was added to the aforementioned titanium oxide fine powder while operating the edge runner, and mixing and stirring were performed.

Then, 150 parts by weight of zinc stearate was added over 10 minutes while operating the edge runner, mixing and stirring were performed, and zinc stearate was added to the surface covered with methyltriethoxysilane which was subjected to heat treatment at 105° C. for 60 minutes, to obtain a fatty acid metal salt-covered inorganic oxide powder (C).

A volume average primary particle diameter of the fine powder was 15 nm and, as a result of observation of the covered state, a covering thickness was in the range of 0.5 to 2.0 nm, and 100% of the surface of a fine powder was covered.

<Preparation of Monodisperse Spherical Silica (A)>

A silica sol obtained by a sol-gel process was subjected to HMDS treatment, and dried and ground to obtain spherical monodisperse silica having a specific gravity of 1.50, a spherical degree ψ of 0.70, and a volume average primary particle diameter D50 of 100 nm (standard deviation: 40 nm).

<Preparation of Monodisperse Spherical Silica (B)>

A silica sol obtained by a sol-gel process was subjected to HMDS treatment, and dried and ground to obtain spherical monodisperse silica having a specific gravity of 1.30, a spherical degree ψ of 0.70, and a volume average primary particle diameter D50 of 120 nm (standard deviation: 40 nm).

(Preparation of Colorant Particle A)

Styrene-n-butyl acrylate resin (Tg: 58° C., Mn: 4000, Mw: 25000): 100 parts

Carbon black (Mogal M, manufactured by Cabot): 3 parts

The aforementioned mixture was kneaded with an extruder, ground with a jet mill, and dispersed with an air classifier to obtain a black toner A having D50 of 5.0 μm and $ML^2/A$ of 148.8.

(Preparation of Colorant Particle B)

<Preparation of Resin Dispersion (1)>

Styrene: 370 parts by weight

Butyl acrylate: 30 parts by weight

Acrylic acid: 8 parts by weight

Dodecanethiol: 24 parts by weight

Carbon tetrabromide: 4 parts by weight

The solution obtained by mixing and dissolving the aforementioned components was emulsion-dispersed in a solution obtained by dissolving 6 parts by weight of a nonionic surfactant (Nonipol400: manufactured by Sanyo Chemical Industries, Ltd.) and 10 parts by weight of an anionic surfactant (NeogenSC: manufactured by Dai-ichi Kogyo Seiyaku Co., Ltd.) in 550 parts by weight of ion-exchanged water in a flask and, into this was placed 50 parts by weight of ion-exchanged water in which 4 parts by weight of ammonium persulfate had been dissolved, while mixing slowly for 10 minutes. After nitrogen replacement, the contents were heated to 70° C. in an oil bath while stirring the flask, and emulsion polymerization was continued for 5 hours under those conditions.

As a result, a resin dispersion (1) was obtained in which a resin particle having an average particle diameter of 155 nm, Tg of 59° C. and weight average molecular weight Mw of 12000 was dispersed.

<Preparation of Resin Dispersion (2)>

Styrene: 280 parts by weight

N-butyl acrylate: 120 parts by weight

Acrylic acid: 8 parts by weight

The solution obtained by mixing and dissolving the aforementioned components was emulsion-dispersed in a solution obtained by dissolving 6 parts by weight of a nonionic surfactant (Nonipol400: manufactured by Sanyo Chemical Industries, Ltd.) and 12 parts by weight of an anionic surfactant (NeogenSC: manufactured by Dai-ichi Kogyo Seiyaku Co., Ltd.) in 550 parts by weight of ion-exchanged water in a flask and, into this was placed 50 parts by weight of ion-exchanged water in which 3 parts by weight of ammonium persulfate had been dissolved, while mixing slowly for 10 minutes. After nitrogen replacement, the contents were heated to 70° C. in an oil bath while stirring the flask, and emulsion polymerization was continued for 5 hours under those conditions.

As a result, a resin dispersion (2) was obtained in which a resin particle having an average particle diameter of 105 nm, Tg of 53° C. and weight average molecular weight Mw of 550000 was dispersed.

<Preparation of Colorant Dispersion (1)>

Carbon black (Mogal L: manufactured by Cabot): 50 parts by weight

Nonionic surfactant (Nonipol400: manufactured by Sanyo Chemical Industries, Ltd.): 5 parts by weight Ion-exchanged water: 200 parts by weight The aforementioned components were mixed and dissolved, and dispersed for 10 minutes using a homogenizer (UltratalaxT50: manufactured by IKA), to obtain a colorant dispersion (1) in which a colorant (carbon black) particle having an average particle diameter of 250 nm was dispersed.

<Preparation of Colorant Dispersion (2)>

Cyan pigment (Pigment Blue 15:3): 70 parts by weight

Nonionic surfactant (Nonipol400: manufactured by Sanyo Chemical Industries, Ltd.): 5 parts by weight Ion-exchanged water: 200 parts by weight The aforementioned components were mixed and dissolved, and dispersed for 10 minutes using a homogenizer (UltratalaxT50: manufactured by IKA), to obtain a colorant dispersion (2) in which a colorant (Cyan pigment) particle having an average particle diameter of 250 nm was dispersed.

<Preparation of Colorant Dispersion (3)>

Magenta pigment (pigment red 120): 70 parts by weight

Nonionic surfactant (Nonipol400: manufactured by Sanyo Chemical Industries, Ltd.): 5 parts by weight Ion-exchanged water: 200 parts by weight The aforementioned components were mixed and dissolved, and dispersed for 10 minutes using a homogenizer (UltratalaxT50: manufactured by IKA), to obtain a colorant dispersion (3) in which a colorant (Magenta pigment) particle having an average particle diameter of 250 nm was dispersed.

<Preparation of Colorant Dispersion (4)>

Yellow pigment (Pigment Yellow 180): 100 parts by weight

Nonionic surfactant (Nonipol400: manufactured by Sanyo Chemical Industries, Ltd.): 5 parts by weight Ion-exchanged water: 200 parts by weight The aforementioned components were mixed and dissolved, and dispersed for 10 minutes using a homogenizer (UltratalaxT50: manufactured by IKA), to obtain a colorant dispersion (4) in which a colorant (Yellow pigment) particle having an average particle diameter of 250 nm was dispersed.

<Preparation of Releasing Agent Dispersion>

Paraffin wax: (HNP0190: manufactured by Nippon Seiro Co., Ltd., melting point 85° C.): 50 parts by weight Cationic surfactant: (SanisolB50: manufactured by Kao Corporation): 5 parts by weight The aforementioned components were dispersed for 10 minutes using a homogenizer (UltratalaxT50: manufactured by IKA) in a round type stainless steel flask, and dispersed using a pressure discharging-type homogenizer, to obtain a releasing agent dispersion (1) in which releasing agent particles having an average particle diameter of 550 nm were dispersed.

<Preparation of Flocculated Particle>

Resin dispersion (1): 120 parts by weight

Resin dispersion (2): 80 parts by weight

Colorant dispersion: 200 parts by weight

Releasing agent dispersion: 40 parts by weight

Cationic surfactant (SanisolB50: manufactured by Kao Corporation: 1.5 parts by weight The aforementioned components were mixed and dispersed using a homogenizer (UltrataracsT50: manufactured by IKA) in a round-type stainless steel flask, and heated to 50° C. while stirring the flask in a heating oil bath. After retaining at 45° C. for 20 minutes, it was confirmed by an optical microscope that a flocculated particle having a volume average particle diameter D50 of about 4.3 μm was formed. Further, to the aforementioned dispersion was added slowly 60 parts by weight of a resin dispersion (1) as a resin-containing fine particle dispersion. Then, a temperature of a heating oil bath was raised to 50° C., and the temperature was retained for 30 minutes. As a result of observation with an optical microscope, it was confirmed that an adhered particle having a volume average primary particle diameter D50 of about 4.5 μm was formed.

<Preparation of Colorant Particle B>

After 3 parts by weight of an anionic surfactant (NeogenSC: manufactured by Dai-ichi Kogyo Seiyaku Co., Ltd.) was added to the aforementioned particle dispersion, the stainless steel flask was sealed, heated to 105° C. while stirring using magnetic force sealing, and the temperature was retained for 4 hours.

And, after cooling, the reaction product was filtered, washed sufficiently with ion-exchanged water, and dried to obtain a colorant particle for developing an electrostatic image.

<Preparation of Colorant Particle B Kuro>

According to the aforementioned procedure using a colorant dispersion (1), a Kuro toner having $ML^2/A$ of 128.5 and a particle diameter D50 of 5.8 μm was obtained.

<Preparation of Colorant Particle B Cyan>

According to the aforementioned procedure using a colorant dispersion (2), a Cyan toner having $ML^2/A$ of 130 and a particle diameter D50 of 5.6 μm was obtained.

<Preparation of Colorant Particle B Magenta>

According to the aforementioned procedure using a colorant dispersion (3), a Magenta toner having $ML^2/A$ of 132.5 and a particle diameter D50 of 5.5 μm was obtained.

<Preparation of Colorant Particle B Yellow>

According to the aforementioned procedure using a colorant dispersion (4), a Yellow toner having $ML^2/A$ of 127 and a particle diameter D50 of 5.9 μm was obtained.

<Preparation of Carrier>

Ferrite particle (volume average particle diameter: 50 μm): 100 parts

Toluene: 14 parts

Styrene-methacrylate copolymer (component ratio: 90/10): 2 parts

Carbon black (R330: manufactured by Cabot): 0.2 part

First, the aforementioned components except for a ferrite particle were stirred for 10 minutes using a stirrer to prepare a dispersed covering solution and, then, this covering solution and a ferrite particle were placed into a vacuum evacuation-type kneader, stirred at 60° C. for 30 minutes, a pressure was reduced to evacuate while warming, and drying afforded a carrier. This carrier had a volume specific resistance value of $10^{11}\Omega$ at an applied electric field of 1000 V/vm.

Example 1

1 part of a fatty acid metal salt-covered inorganic oxide powder (A), and 1.3 parts of hydrophobic silica having a volume average primary particle diameter of 40 nm (RX50, manufactured by Nippon Aerosil Co., Ltd.) were added to each 100 parts of Kuro, Cyan, Magenta and Yellow toners of the aforementioned colorant particles B, the mixture was blended for 10 minutes using a Henschel mixer at a circumferential speed of 32 m/s, and crude particles were removed using a 45 μm mesh sieve, to obtain a toner.

100 parts of the carrier and 5 parts of the toner were stirred for 20 minutes using a V-blender at 40 rpm, and classified with a sieve having a 177 μm mesh sieve to obtain a developer.

Using the aforementioned developer, the developing property and the transferring property were assessed using a modified copying machine Docu Centre Color 400CP manufactured by Fuji Xerox Co., Ltd. having a tandem system.

For assessing the developing property, a developer having a toner concentration of 5% by weight was respectively allowed to stand overnight under each temperature and humidity, an image having a 2 cm×5 cm patch at each of two places was copied, and a developed amount at hard stop was measured. In other words, a developed amount was obtained by respectively transferring developed parts at the two places on a photosensitive member onto pieces of tape by utilizing the adhesiveness thereof, measuring the weight of each piece of tape with toner adhered thereto, respectively subtracting the weight of each piece of tape from the measured weights, and averaging the two resulting figures.

Determination was performed by designating values within the desired range of 4.0 to 5.0 $g/m^2$ as ○ and designating values outside of the range as X. For assessing fog, determination was performed by similarly transferring a background part onto a piece of tape, counting the number of toner particles per 1 $cm^2$, designating values of 100 or less as ○, designating values of 100 to 500 as Δ and designating values of greater than 500 as X.

For assessing the transferring property, an amount of a transferred toner (a) was obtained by transferring weight of toner on the surface of two places of an intermediate transferring member onto a piece of tape similarly, respectively measuring the weight of each piece of tape with toner adhered thereto, respectively subtracting the weight of tapes from the measured weight, and averaging the two resulting figures, and an amount of a toner remaining on the surface of a photosensitive member (b) was obtained similarly, and the transfer efficiency was obtained from the following equation:

$$\text{Transfer efficiency } \eta\ (\%) = a \times 100/(a+b)$$

The desired value is the transfer efficiency $\eta \geqq 99\%$ and, using this as a standard, the following determination was performed:

| | |
|---|---|
| $\eta \geqq 99\%$ | ○ |
| $90\% \geqq \eta < 99\%$ | Δ |
| $\eta < 90\%$ | X |

Regarding the above assessments, the results of an initial stage are shown in Table 1, and the results after 20,000 images were copied are shown in Table 2.

Example 2

1 part of a fatty acid metal salt-covered inorganic oxide powder (B) and 1.4 parts of hydrophobic silica (RX50, manufactured by Nippon Aerosil Co., Ltd.) having a volume average primary particle diameter of 40 nm were added to 100 parts of the aforementioned colorant particle B Kuro, the mixture was blended for 10 minutes using a Henschel mixer at a circumferential speed of 32 m/s, and crude particles were removed using a 45 μm mesh sieve to obtain a toner.

100 parts of the aforementioned carrier and 5 parts of the aforementioned toner were stirred for 20 minutes at 40 rpm using a V-blender and classified with a sieve having 177 μm mesh to obtain a developer.

The developer was assessed as in Example 1. The results are shown in Tables 1 and 2.

Example 3

0.7 part of a fatty acid metal salt-covered inorganic oxide powder (C) and 1.5 parts of hydrophobic titanium oxide (TAF-500S, manufactured by Fujititan) having a volume average primary particle diameter of 50 nm were added to 100 parts of the aforementioned colorant particle B Kuro, the mixture was blended for 10 minutes using a Henschel mixer at a circumferential speed of 32 m/s, and crude particles were removed using a 45 μm mesh sieve to obtain a toner.

100 parts of the aforementioned carrier and 5 parts of the aforementioned toner were stirred for 20 minutes at 40 rpm using a V-blender and classified with a sieve having 177 μm mesh to obtain a developer.

The developer was assessed as in Example 1. The results are shown in Tables 1 and 2.

Example 4

1.3 part of a fatty acid metal salt-covered inorganic oxide powder (A) and 1.2 parts of hydrophobic silica (RX50 manufactured by Nippon Aerosil Co., Ltd.) having a volume average primary particle diameter of 40 nm were added to 100 parts of the aforementioned colorant particle AKuro, the mixture was blended for 10 minutes using a Henschel mixer at a circumferential speed of 32 m/s, and crude particles were removed using a 45 μm mesh sieve to obtain a toner.

100 parts of the aforementioned carrier and 5 parts of the aforementioned toner were stirred for 20 minutes at 40 rpm using a V-blender and classified with a sieve having 177 μm mesh to obtain a developer.

The developer was assessed as in Example 1. The results are shown in Tables 1 and 2.

Example 5

2 parts of monodisperse spherical silica (A) was added to 100 parts of the aforementioned colorant particle B Kuro, the mixture was blended for 10 minutes using a Henschel mixer at a circumferential speed of 32 m/s, 1 part of a fatty acid metal salt-covered inorganic oxide powder (A) and 1.4 parts of hydrophobic silica (RX50, manufactured by Nippon Aerosil Co., Ltd.) having a volume average primary particle diameter of 40 nm were added, the mixture was blended for 5 minutes at a circumferential speed of 20 m/s, and crude particles were removed using a 45 μm mesh sieve to obtain a toner.

100 parts of the aforementioned carrier and 5 parts of the aforementioned toner were stirred for 20 minutes at 40 rpm using a V-blender and classified with a sieve having 177 μm mesh to obtain a developer.

The developer was assessed as in Example 1. The results are shown in Tables 1 and 2.

Example 6

1.5 parts of monodisperse spherical silica (B) was added to 100 parts of the aforementioned colorant particle B Kuro, the mixture was blended for 10 minutes using a Henschel mixer at a circumferential speed of 32 m/s, 1 part of a fatty acid metal salt-covered inorganic oxide powder (A) and 1.4 parts of hydrophobic silica (RX50, manufactured by Nippon Aerosil Co., Ltd.) having a volume average primary particle diameter of 40 nm were added, the mixture was blended for 5 minutes at a circumferential speed of 20 m/s, and crude particles were removed using a 45 μm mesh sieve to obtain a toner.

100 parts of the aforementioned carrier and 5 parts of the aforementioned toner were stirred for 20 minutes at 40 rpm using a V-blender and classified with a sieve having 177 μm mesh to obtain a developer.

The developer was assessed as in Example 1. The results are shown in Tables 1 and 2.

Example 7

2 parts of monodisperse spherical silica (A), 1 part of a fatty acid metal salt-covered inorganic oxide powder (A) and 1.4 parts of hydrophobic silica (RX50, manufactured by Nippon Aerosil Co., Ltd.) having a volume average primary particle diameter of 40 nm were added to 100 parts of the aforementioned colorant particle B Kuro, the mixture was blended for 10 minutes using a Henschel mixer at a circumferential speed of 32 m/s, and crude particles were removed using a 45 μm mesh sieve to obtain a toner.

100 parts of the aforementioned carrier and 5 parts of the aforementioned toner were stirred for 20 minutes at 40 rpm using a V-blender and classified with a sieve having 177 μm mesh to obtain a developer.

The developer was assessed as in Example 1. The results are shown in Tables 1 and 2.

Comparative Example 1

0.7 part of a titanium oxide fine powder MT-150A (particle shape: rice particulate, BET specific surface area: 67.5 $m^2/g$, volume average primary particle diameter: 20 nm) treated with 10% decyltrimethoxysilane, and 1.2 parts of hydrophobic silica (RX50, Nippon Aerosil Co., Ltd.) having a volume average primary particle diameter of 40 nm were added to 100 parts of the aforementioned colorant particle B Kuro, the mixture was blended for 10 minutes using a Henschel mixer at a circumferential speed of 32 m/s, and crude particles were removed using a 45 μm mesh sieve to obtain a toner.

100 parts of the aforementioned carrier and 5 parts of the aforementioned toner were stirred for 20 minutes at 40 rpm using a V-blender and classified with a sieve having 177 μm mesh to obtain a developer.

The developer was assessed as in Example 1. The results are shown in Tables 1 and 2.

Comparative Example 2

A developer was obtained in the same manner as in Example 2 except in that the hydrophobic silica (RX50, manufactured by Nippon Aerosil Co., Ltd.) having an average particle diameter of 40 nm was not used.

The developer was assessed as in Example 1. The results are shown in Tables 1 and 2.

TABLE 1

| | Developing property | | | | | | | | | | | |
|---|---|---|---|---|---|---|---|---|---|---|---|---|
| | Electrifying property (−μC/g) | | Solid developed amount (g/m²) | | | | Fogged toner (Grade) | | | | Transferring property (Transfer efficiency (%)) | |
| | Temperature and humidity (29° C. 90%) | Temperature and humidity (10° C. 20%) | Temperature and humidity (29° C. 90%) | | Temperature and humidity (10° C. 20%) | | Temperature and humidity (29° C. 90%) | | Temperature and humidity (10° C. 20%) | | Temperature and humidity (29° C. 90%) | | Temperature and humidity (10° C. 20%) | |
| Example 1 | | | | | | | | | | | | | | |
| Kuro | 35 | 40 | 4.6 | ○ | 4.2 | ○ | 50 | ○ | 46 | ○ | 97.7 | Δ | 98.7 | Δ |
| Cyan | 35 | 40 | 4.3 | ○ | 4.1 | ○ | 73 | ○ | 32 | ○ | 96.6 | Δ | 98.2 | Δ |
| Magenta | 34 | 36 | 4.8 | ○ | 4.6 | ○ | 39 | ○ | 60 | ○ | 97.2 | Δ | 98.8 | Δ |
| Yellow | 37 | 44 | 4.4 | ○ | 4.2 | ○ | 68 | ○ | 35 | ○ | 97.7 | Δ | 99.0 | ○ |
| Example 2 | 34 | 40 | 4.4 | ○ | 4.2 | ○ | 56 | ○ | 51 | ○ | 97.9 | Δ | 98.8 | Δ |
| Example 3 | 32 | 36 | 4.8 | ○ | 4.6 | ○ | 76 | ○ | 91 | ○ | 95.9 | Δ | 98.5 | Δ |
| Example 4 | 33 | 38 | 4.5 | ○ | 4.3 | ○ | 64 | ○ | 45 | ○ | 95.0 | Δ | 97.8 | Δ |
| Example 5 | 37 | 43 | 4.3 | ○ | 4.0 | ○ | 46 | ○ | 23 | ○ | 99.5 | ○ | 99.9 | ○ |
| Example 6 | 35 | 43 | 4.2 | ○ | 4.1 | ○ | 58 | ○ | 77 | ○ | 99.2 | ○ | 99.9 | ○ |
| Example 7 | 35 | 41 | 4.4 | ○ | 4.2 | ○ | 110 | Δ | 132 | Δ | 99.5 | ○ | 99.9 | ○ |
| Comparative Example 1 | 30 | 42 | 4.8 | ○ | 4.0 | ○ | 115 | Δ | 65 | ○ | 93.8 | Δ | 95.3 | Δ |
| Comparative Example 2 | 31 | 35 | 4.5 | ○ | 4.7 | ○ | 55 | ○ | 46 | ○ | 88.3 | X | 93.6 | Δ |
| Comparative Example 3 | 30 | 40 | 4.8 | ○ | 4.2 | ○ | 68 | ○ | 75 | ○ | 89.5 | X | 94.0 | Δ |

TABLE 2

| | Developing property | | | | | | | | | | | |
|---|---|---|---|---|---|---|---|---|---|---|---|---|
| | Electrifying property (−μC/g) | | Solid developed amount (g/m²) | | | | Fogged toner (Grade) | | | | Transferring property (Transfer efficiency (%)) | |
| | Temperature and humidity (29° C. 90%) | Temperature and humidity (10° C. 20%) | Temperature and humidity (29° C. 90%) | | Temperature and humidity (10° C. 20%) | | Temperature and humidity (29° C. 90%) | | Temperature and humidity (10° C. 20%) | | Temperature and humidity (29° C. 90%) | | Temperature and humidity (10° C. 20%) | |
| Example 1 | | | | | | | | | | | | | | |
| Kuro | 27 | 37 | 4.7 | ○ | 4.5 | ○ | 59 | ○ | 39 | ○ | 94.9 | Δ | 96.8 | Δ |
| Cyan | 32 | 37 | 4.5 | ○ | 4.5 | ○ | 86 | ○ | 86 | ○ | 93.5 | Δ | 95.9 | Δ |
| Magenta | 29 | 32 | 4.8 | ○ | 4.7 | ○ | 69 | ○ | 84 | ○ | 92.7 | Δ | 95.3 | Δ |
| Yellow | 33 | 40 | 4.4 | ○ | 4.3 | ○ | 86 | ○ | 71 | ○ | 96.8 | Δ | 97.8 | Δ |
| Example 2 | 32 | 35 | 4.6 | ○ | 4.6 | ○ | 95 | ○ | 46 | ○ | 96.1 | Δ | 97.7 | Δ |
| Example 3 | 28 | 33 | 4.9 | ○ | 4.7 | ○ | 119 | Δ | 135 | Δ | 93.8 | Δ | 98.0 | Δ |
| Example 4 | 30 | 35 | 4.6 | ○ | 4.4 | ○ | 105 | Δ | 95 | ○ | 92.5 | Δ | 95.6 | Δ |
| Example 5 | 35 | 40 | 4.3 | ○ | 4.4 | ○ | 87 | ○ | 120 | Δ | 99.0 | ○ | 99.3 | ○ |
| Example 6 | 32 | 38 | 4.5 | ○ | 4.4 | ○ | 85 | ○ | 77 | ○ | 99.2 | ○ | 99.7 | ○ |
| Example 7 | 31 | 38 | 4.6 | ○ | 4.3 | ○ | 160 | Δ | 136 | Δ | 98.1 | Δ | 99.3 | ○ |
| Comparative Example 1 | 22 | 30 | 5.5 | X | 5.0 | ○ | 562 | X | 583 | X | 90.5 | Δ | 94.6 | Δ |
| Comparative Example 2 | 26 | 31 | 5.0 | ○ | 5.0 | ○ | 149 | Δ | 113 | Δ | 73.6 | X | 76.5 | X |
| Comparative Example 3 | 27 | 34 | 5.0 | ○ | 4.8 | ○ | 185 | Δ | 145 | Δ | 73.2 | X | 79.0 | X |

The developer was assessed as in Example 1. The results are shown in Tables 1 and 2.

Comparative Example 3

A developer was obtained in the same manner as in Example 2, except in that the 1 part of the fatty acid metal salt-covered inorganic oxide powder (B) was replaced with 1.2 parts of hydrophobic silica (R812, manufactured by Nippon Aerosil Co., Ltd.) having an average particle diameter of 8 nm.

The developer was assessed in Example 1. The results are shown in Table 1 and 2.

As described above, a developer of a toner composition of using a powder, in which two or more kinds of inorganic oxide powders having different volume average primary particle diameters are added and one kind of them has the surface covered with a fatty acid metal salt, had the better electrification maintaining property, and had the better transferring property also in long term repetitive use, as shown by the results of Examples 1 to 7. In addition, in assessment of each developer, a photosensitive member was extracted after 20,000 images were copied, the surface was observed, and flaw and contamination were slight.

On the other hand, a developer of a toner composition using a powder, in which two or more kinds of inorganic oxide powders having different volume average primary particle diameters are added, but an inorganic oxide powder having the surface covered with a fatty acid metal salt is not added, was slightly inferior in the transferring property in long term repetitive use, caused fog and was worse in the electrification maintaining property, as shown by the results of Comparative Example 1. A photosensitive member was extracted after 20,000 images were copied, the surface was observed, and flaw was clearly confirmed. In addition, a developer of a toner composition, in which only inorganic oxide fine particles having small particle diameter are added, had the insufficient transferring property from an initial stage, as shown by the results of Comparative Examples 2 and 3.

Example 8

Assessment was performed in the same manner as in Example 5 except in that the cleaning blade of the system was removed, an electrostatic brush comprising a fibrous resin having an electrically conductive filler in which carbon black was dispersed was added, and the electrifying apparatus was replaced with a roll electrifying apparatus.

As a result, a clear image was exhibited not only at an initial stage but also after 20,000 images were copied, no problems with the images arose.

Example 9

Assessment was performed in the same manner as in Example 5 except in that blade and brush cleaning of the system were not carried out at all, and toner was recovered in the developing apparatus using a Scotron electrifying equipment.

As a result, a clear image was exhibited not only at an initial stage but also after 20,000 images were copied, and no problems with the images arose.

Example 10

The example was performed in the same manner as Example 5 except in that a surface material of a transferring belt was replaced with PFA, an apparatus for heating from a rear surface was added to perform transference and fixation at the same time. In addition, the external additive composition of four color toners in Example 1 were replaced with the external additive composition in Example 5 to make four colors. A combination of colors was studied and, as a result, a clear and high quality image close to that of photography was obtained.

Then, other Examples (Examples 11 to 19) will be described as follows.

<Measurement of covering uniformity of inorganic oxide powder>, <measurement of specific gravity of external additive>, <measurement of primary particle diameter of external additive and standard deviation therefor>, <spherical degree>, <measurement of resistance>, <average shape index SF1 ($ML^2/A$)>, <measurement of electrification amount>and <Solid Area Density>are the same as those described above.

An external additive was prepared as follows:

<Preparation of Wax-covered Inorganic Oxide Powder (A)>

3,000 parts by weight of a titanium oxide fine powder MT-150A (particle shape: rice particulate, BET specific surface area: 67.5 $m^2/g$, volume average primary particle diameter: 20 nm, manufactured by Tayca Corporation) was placed into an edge runner "MPUV-2 type" (trade name, manufactured by Matsumoto Chuzotekkosho K.K.). A methyltriethoxysilane solution in which 50 parts by weight of methyltriethoxysilane (trade name: TSL8123: manufactured by GE Toshiba Silicones) was diluted in 200 parts by weight of ethanol was added to the titanium oxide fine powder while operating the edge runner, and they were mixed and stirred.

Then, 150 parts by weight of purified particulate carnauba wax (melting point: 82 degree, manufactured by Toa Kasei Co., Ltd.) was added over 10 minutes while operating the edge runner, mixing and stirring were performed to adhere purified particulate carnauba wax on a methyltrimethoxysilane covering and heating treatment at 105° C. for 60 minutes was performed using drying, to obtain a wax-covered inorganic oxide powder (A).

The wax-covered inorganic oxide powder (A) had a volume average primary particle diameter of 23 nm, the covered state was observed, and it was found that a covered thickness was in the range of 1.0 to 2.0 nm and 95% of the surface of a fine powder was covered.

<Preparation of Wax-covered Inorganic Oxide Powder (B)>

3,000 parts by weight of a titanium oxide fine powder TAF-1500 (particle shape: undefined, BET specific surface area: 55.0 $m^2/g$, volume average primary particle diameter: 20 nm, manufactured by Fuji Titanium Industry Co., Ltd.) was placed into an edge runner "MPUV-2 type" (product name, manufactured by Matsumoto Tyuzotekkosho K.K.), a methyltriethoxysilane solution obtained by diluting 50 parts by weight of methyltriethoxysilane (trade name: TSL8123: manufactured by GE Toshiba Silicones) with 200 parts by weight of ethanol was added to the titanium oxide fine powder while operating the edge runner, and mixing and stirring were performed.

Then, 150 parts by weight of polywax 725 (melting point: 103 degree, manufactured by Toyo-Petrolite K.K.) was added over 10 minutes while operating the edge runner, mixing and stirring were performed to adhere polywax 725 on a methyltriethoxysilane covering, and heating treatment at 105° C. for 60 minutes was performed using drying, to obtain a wax-covered inorganic oxide powder (B).

The wax-covered inorganic oxide powder (B) had a volume average primary particle diameter of 24 nm, the covering state was observed so as to find that a covering thickness was in the range of 1.0 to 2.0 nm and 100% of the surface of a fine powder was covered.

<Preparation of Wax-Covered Inorganic Oxide Powder (C)>

1500 parts by weight of a silicon oxide fine powder A200 (particle shape: undefined, BET specific surface area: 190 $m^2/g$, volume average primary particle diameter: 12 nm, manufactured by Nippon Aerosil Co., Ltd.) was placed into an edge runner "MPUV-2 type" (product name, manufactured by Matsumoto Chuzotekkosho K.K.). A methyltriethoxysilane solution in which 50 parts by weight of methyltriethoxysilane (trade name: TSL8123: manufactured by GE Toshiba Silicones) was diluted in 200 parts by weight of ethanol was added to the titanium oxide fine powder while operating the edge runner, and they were mixed and stirred.

Then, 100 parts by weight of polyethylene wax PE130 (melting point: 130 degree, manufactured by Mitsui Chemicals, Inc.) was added over 10 minutes while operating the edge runner, mixing and stirring were performed to adhere PE 130 on a methyltriethoxysilane covering, and heating treatment at 105° C. for 60 minutes was performed using drying, to obtain a wax-covered inorganic oxide powder (C).

The wax-covered inorganic oxide powder (C) had a volume average primary particle diameter of 15 nm, the covered state was observed, and it was found that a covering thickness was in the range of 0.5 to 1.5 nm, and 100% of the surface of fine powder was covered.

<Preparation of monodisperse spherical silica (A)>, <preparation of monodisperse spherical silica (B)>, (preparation of colorant particle A), (preparation of colorant particle B), <preparation of resin dispersion (1)>, <preparation of resin dispersion (2)>, <preparation of colorant dispersion (1)>, <preparation of colorant dispersion (2)>, <preparation of colorant dispersion (3)>, <preparation of colorant dispersion (4)>, <preparation of releasing agent dispersion>, <preparation of flocculated particle>, <preparation of colorant particle B>, <preparation of colorant particle B Kuro>, <preparation of colorant particle B Cyan>, <preparation of colorant particle B Magenta>, <preparation of colorant particle B Yellow>and <preparation of carrier>are the same as those described above.

Example 11

1 part of a wax-covered inorganic oxide powder (B) and 1.3 parts of hydrophobic silica (RX50, manufactured by Nippon Aerosil Co., Ltd.) having a volume average primary particle diameter of 40 nm were added to each 100 parts of Kuro, Cyan, Magenda and Yellow toners of the aforementioned colorant particle B. The mixture was then blended for 10 minutes using a Henschel mixer at a circumferential speed of 32 m/s. Crude particles were removed using a 45 μm mesh sieve to obtain a toner. 100 parts of a carrier and 5 parts of the toner were stirred for 20 minutes at 40 rpm using a V-blender, and classified with a sieve having a 177 μm mesh to obtain a developer.

Example 12

1 part of a wax-covered inorganic oxide powder (A) and 1.4 parts of hydrophobic silica (RX50, manufactured by Nippon Aerosil Co., Ltd.) having a volume average primary particle diameter of 40 nm were added to each 100 parts of the aforementioned colorant B Kuro, the mixture was blended for 10 minutes using a Henschel mixer at a circumferential speed of 32 m/s, crude particles were removed using a 45 μm mesh sieve to obtain a toner. 100 parts of a carrier and 5 parts of the toner were stirred for 20 minutes at 40 rpm using a V-blender, and classified with a sieve having a 177 μm mesh to obtain a developer.

Example 13

0.7 part of a wax-covered inorganic oxide powder (C) and 1.5 parts of hydrophobic titanium oxide (TAF-500S, manufactured by Fujititan) having a volume average primary particle diameter of 50 nm were added to each 100 parts of the aforementioned colorant B Kuro. The mixture was blended for 10 minutes using a Henschel mixer at a circumferential speed of 32 m/s. Crude particles were removed using a 45 μm mesh sieve to obtain a toner. 100 parts of a carrier and 5 parts of the toner were stirred for 20 minutes at 40 rpm using a V-blender, and classified with a sieve having a 177 μm mesh to obtain a developer.

Example 14

1.3 parts of a wax-covered inorganic oxide powder (B) and 1.2 parts of hydrophobic silica (RX50, manufactured by Nippon Aerosil Co., Ltd.) having a volume average primary particle diameter of 40 nm were added to each 100 parts of the aforementioned colorant B Kuro. The mixture was blended for 10 minutes using a Henschel mixer at a circumferential speed of 32 m/s. Crude particles were removed using a 45 μm mesh sieve to obtain a toner. 100 parts of a carrier and 5 parts of the toner were stirred for 20 minutes at 40 rpm using a V-blender, and classified with a sieve having a 177 μm mesh to obtain a developer.

Example 15

2 parts of monodisperse spherical silica (A) was added to 100 parts of the aforementioned colorant particle B Kuro. The mixture was blended for 10 minutes using a Henschel mixer at a circumferential speed of 32 m/s. 1 part of a wax-covered inorganic oxide powder (A) and 1.5 parts of hydrophobic silica (RX50, manufactured by Nippon Aerosil Co., Ltd.) having a volume average primary particle diameter of 40 nm were added. The mixture was blended for 5 minutes at a circumferential speed of 20 m/s, and crude particles were removed using a 45 μm mesh sieve, to obtain a toner. 100 parts of a carrier and 5 parts of the toner were stirred for 20 minutes at 40 rpm using a V-blender, and classified with a sieve having a 177 μm mesh to obtain a developer.

Example 16

1.5 parts of monodisperse spherical silica (B) was added to 100 parts of the aforementioned colorant particle B Kuro. The mixture was blended for 10 minutes using a Henschel mixer at a circumferential speed of 32 m/s. 1 part of a wax-covered inorganic oxide powder (A) and 1.5 parts of hydrophobic silica (RX50, manufactured by Nihon Aerosil) having a volume average primary particle diameter of 40 nm were added. The mixture was blended for 5 minutes at a circumferential speed of 20 m/s, and crude particles were removed using a 45 μm mesh sieve, to obtain a toner. 100 parts of a carrier and 5 parts of the toner were stirred for 20 minutes at 40 rpm using a V-blender, and classified with a sieve having a 177 μm mesh to obtain a developer.

Example 17

2 parts of monodisperse spherical silica (A), 1 part of a wax-covered inorganic oxide powder (A) and 1.4 parts of hydrophobic silica (RX50, manufactured by Nippon Aerosil Co., Ltd.) having a volume average primary particle diameter 40 nm were added to 100 parts of aforementioned colorant particle B Kuro. The mixture was blended for 10 minutes using a Henschel mixer at a circumferential speed of 32 m/s, and crude particles were removed using a 45 μm mesh sieve, to obtain a toner. 100 parts of a carrier and 5 parts of the toner were stirred for 20 minutes at 40 rpm using a V-blender, and classified with a sieve having a 177 μm mesh to obtain a developer.

Comparative Example 4

0.7 part of a fine powder obtained by treating a titanium oxide fine powder (MT-150A (particle shape: rice particulate, BET specific surface area: 67.5 $m^2/g$, volume average primary particle diameter: 20 nm) with 10% decyltrimethoxysilane, and 1.2 parts of hydrophobic silica (RX50, Nippon Aerosil Co., Ltd.) having a volume average primary particle diameter of 40 nm were added to 100 parts of the aforementioned colorant particle B Kuro. The mixture was blended for 10 minutes using a Henschel mixer at a circumferential speed of 32 m/s, and crude particles were removed using a 45 μm mesh sieve, to obtain a toner. 100 parts of a carrier and 5 parts of the toner were stirred for 20 minutes at 40 rpm using a V-blender, and classified with a sieve having a 177 μm mesh to obtain a developer.

Comparative Example 5

A developer was obtained in the same manner as in Example 12 except in that the hydrophobic silica (RX50, manufactured by Nippon Aerosil Co., Ltd.) having an average particle diameter of 40 nm was omitted.

Comparative Example 6

A developer was obtained in the same manner as in Example 12 except in that the 1 part of the wax-covered inorganic oxide powder (A) was replaced with 1.2 parts of hydrophobic silica (R812, manufactured by Nippon Aerosil Co., Ltd.) having an average particle diameter of 8 nm.

Using developers obtained in the aforementioned Examples and Comparative Examples, the developing properties and the transferring property were assessed using a copying machine Docu Centre Color 400CP manufactured by Fuji Xerox Co., Ltd. having a tandem system.

Further, a copying machine was modified so that a fixation setting temperature can be changed, an offset occurring temperature for fixation was assessed. A used image forming apparatus (Docu Centre Color 400CP) carries a belt fixing system without supply of a releasing oil.

(Offset Property)

Using Docu Centre Color 400CP, a solid unfixed toner image, longitudinal 5 cm and transverse 4 cm, was prepared on an A4 transferring paper. Upon this, a toner image was prepared so that an amount of a toner became 0,5 to 0.7 mg/cm$^2$. Then, a test was performed using Docu Centre Color 400CP modified so that a fixing belt temperature can be arbitrarily set and monitored. That is, a temperature of the surface of a fixing belt was changed step-wisely, and a transferring paper retaining the toner image was treated at each temperature of the surface, to perform fixation of an unfixed toner image. Upon this, whether toner stain occurs at a space part or not was observed, and such a temperature region that no stain occurs was regarded as a non-offset temperature region. The results are shown in Tables 3 to 5 below.

Table 3 shows the results of assessment of the electrifying property, the developing property and the transferring property at initial image formation under the high temperature and high humidity environment (temperature 29° C., humidity 90% ) and under the low temperature and low humidity environment (temperature 10° C., humidity 20% ). Table 4 shows the results of assessment of the electrifying property, the developing property and the transferring property after 20,000 images were made under the high temperature and high humidity environment (temperature 29° C., humidity 90% ) and under the low temperature and low humidity environment (temperature 10° C., humidity 20% ). Table 5 shows the results of assessment of a non-offset temperature region at initial image formation.

TABLE 3

Results of Docu Centre Color 400CP assessment (initial)

| | Electrifying property (−μC/g) | | Developing property: Solid developed amount (@ TC5%: g/m$^2$) | | | | Developing property: Fogged toner (Grade) | | | | Transferring property (Transfer efficiency % = transferred amount/developed amount) | | | |
|---|---|---|---|---|---|---|---|---|---|---|---|---|---|---|
| | Temperature and humidity = 29° C. 90% | Temperature and humidity = 10° C. 20% | Temperature and humidity = 29° C. 90% | | Temperature and humidity = 10° C. 20% | | Temperature and humidity = 29° C. 90% | | Temperature and humidity = 10° C. 20% | | Temperature and humidity = 29° C. 90% | | Temperature and humidity = 10° C. 20% | |
| Example 11 | | | | | | | | | | | | | | |
| Kuro | 33 | 38 | 4.6 | ○ | 4.3 | ○ | 50 | ○ | 35 | ○ | 95.7 | Δ | 97.7 | Δ |
| Cyan | 36 | 40 | 4.3 | ○ | 4.1 | ○ | 60 | ○ | 20 | ○ | 94.6 | Δ | 96.2 | Δ |
| Magenta | 33 | 37 | 4.8 | ○ | 4.5 | ○ | 50 | ○ | 62 | ○ | 95.2 | Δ | 96.3 | Δ |
| Yellow | 37 | 42 | 4.4 | ○ | 4.3 | ○ | 73 | ○ | 42 | ○ | 96.0 | Δ | 97.0 | Δ |
| Example 12 | 32 | 38 | 4.5 | ○ | 4.3 | ○ | 49 | ○ | 68 | ○ | 97.8 | Δ | 97.8 | Δ |
| Example 13 | 30 | 34 | 4.8 | ○ | 4.8 | ○ | 68 | ○ | 83 | ○ | 95.3 | Δ | 98.0 | Δ |
| Example 14 | 32 | 38 | 4.6 | ○ | 4.3 | ○ | 49 | ○ | 76 | ○ | 92.0 | Δ | 94.8 | Δ |
| Example 15 | 36 | 41 | 4.3 | ○ | 4.1 | ○ | 83 | ○ | 58 | ○ | 99.5 | ○ | 99.8 | ○ |
| Example 16 | 32 | 40 | 4.4 | ○ | 4.3 | ○ | 77 | ○ | 91 | ○ | 99.0 | ○ | 99.9 | ○ |
| Example 17 | 34 | 40 | 4.4 | ○ | 4.3 | ○ | 115 | Δ | 128 | Δ | 99.2 | ○ | 99.5 | ○ |
| Comparative Example 4 | 30 | 42 | 4.8 | ○ | 4.0 | ○ | 115 | Δ | 65 | ○ | 93.8 | Δ | 95.3 | Δ |
| Comparative Example 5 | 31 | 35 | 4.5 | ○ | 4.7 | ○ | 55 | ○ | 46 | ○ | 88.3 | X | 93.6 | Δ |
| Comparative Example 6 | 30 | 40 | 4.8 | ○ | 4.2 | ○ | 68 | ○ | 75 | ○ | 89.5 | X | 94.0 | Δ |

TABLE 4

Results of Docu Centre Color 400CP assessment (after 20,000 images were made)

| | Electrifying property (−μC/g) | | Developing property: Solid developed amount (g/m²) | | | | Developing property: Fogged toner (Grade) | | | | Transferring property (Transfer efficiency % = transferred amount/developed amount) | | | |
|---|---|---|---|---|---|---|---|---|---|---|---|---|---|---|
| | Temperature and humidity = 29° C. 90% | Temperature and humidity = 10° C. 20% | Temperature and humidity = 29° C. 90% | | Temperature and humidity = 10° C. 20% | | Temperature and humidity = 29° C. 90% | | Temperature and humidity = 10° C. 20% | | Temperature and humidity = 29° C. 90% | | Temperature and humidity = 10° C. 20% | |
| Example 11 | | | | | | | | | | | | | | |
| Kuro | 28 | 38 | 4.7 | ○ | 4.5 | ○ | 76 | ○ | 49 | ○ | 92.0 | Δ | 95.8 | Δ |
| Cyan | 33 | 35 | 4.5 | ○ | 4.7 | ○ | 86 | ○ | 96 | ○ | 91.3 | Δ | 95.5 | Δ |
| Magenta | 30 | 33 | 4.7 | ○ | 4.7 | ○ | 82 | ○ | 76 | ○ | 90.8 | Δ | 94.2 | Δ |
| Yellow | 37 | 40 | 4.2 | ○ | 4.3 | ○ | 67 | ○ | 63 | ○ | 93.7 | Δ | 97.7 | Δ |
| Example 12 | 32 | 37 | 4.6 | ○ | 4.5 | ○ | 89 | ○ | 75 | ○ | 92.8 | Δ | 96.1 | Δ |
| Example 13 | 27 | 32 | 4.9 | ○ | 4.7 | ○ | 123 | Δ | 95 | ○ | 91.5 | Δ | 95.6 | Δ |
| Example 14 | 30 | 38 | 4.6 | ○ | 4.6 | ○ | 112 | Δ | 85 | ○ | 90.8 | Δ | 93.6 | Δ |
| Example 15 | 32 | 37 | 4.4 | ○ | 4.5 | ○ | 145 | Δ | 92 | ○ | 99.2 | ○ | 99.2 | ○ |
| Example 16 | 30 | 38 | 4.6 | ○ | 4.4 | ○ | 87 | ○ | 92 | ○ | 99.0 | ○ | 99.5 | ○ |
| Example 17 | 30 | 40 | 4.6 | ○ | 4.2 | ○ | 220 | Δ | 156 | Δ | 97.0 | Δ | 99.2 | ○ |
| Comparative Example 4 | 22 | 30 | 5.5 | X | 5.0 | ○ | 562 | X | 583 | X | 90.5 | Δ | 94.6 | Δ |
| Comparative Example 5 | 26 | 31 | 5.0 | ○ | 5.0 | ○ | 149 | Δ | 113 | Δ | 73.6 | X | 76.5 | X |
| Comparative Example 6 | 27 | 34 | 5.0 | ○ | 4.8 | ○ | 185 | Δ | 145 | Δ | 73.2 | X | 79.0 | X |

TABLE 5

Results of fixing assessment (initial)

| | Non-offset temperature region (° C.) |
|---|---|
| Example 11 | 150 to 220 |
| Example 12 | 150 to 220 |
| Example 13 | 150 to 220 |
| Example 14 | 145 to 220 |
| Example 15 | 150 to 210 |
| Example 16 | 150 to 210 |
| Example 17 | 150 to 210 |
| Comparative Example 4 | 150 to 180 |
| Comparative Example 5 | 150 to 190 |
| Comparative Example 6 | 150 to 180 |

A method of assessing the developing property and the transferring property shown in Table 3 and Table 4 and assessment of criteria therefor are as follows:

(Method of Assessing Developing Property and Assessment Criteria Therefor)

For assessing the developing property, a developer having a toner concentration of 5% by weight was respectively allowed to stand overnight under each temperature and humidity, an image having a 2 cm×5 cm patch at each of two places was copied, and a developed amount at hard stop was measured. In other words, a developed amount was obtained by respectively transferring developed parts at the two places on a photosensitive member onto pieces of tape by utilizing the adhesiveness thereof, measuring the weight of each piece of tape with toner adhered thereto, respectively subtracting the weight of each piece of tape from the measured weights, and averaging the two resulting figures. In addition, fog was assessed by similarly transferring a background part on a piece of tape, and counting the number of toner particles per 1 cm².

"○", "Δ" and "X" shown in Table 3 and Table 4 specifically mean as follows:

Criteria for Measuring Solid Developed Amount

○: A developed amount is within the range of 4.0 g/m² to 5.0 g/m².

X: A developed amount is outside a range of 4.0 g/m² to 5.0 g/m².

Criteria of Assessing Fogged Toner

○: The number of toner particles transferred on a piece of tape is 100 or less.

Δ: The number of toner particles transferred on a piece of tape is more than 100 and not more than 500.

X: The number of toner particles transferred on a piece of tape is more than 500.

(Method for Assessing Transferring Property and Assessment Criteria Therefor)

For assessing the transferring property, hard stop was performed at completion of a transferring step, an amount of a transferred toner (a) was obtained by transferring weight of toners on an intermediate transferring member at two places on a piece of tape as described above, respectively measuring the weight of each piece of tape with toner adhered thereto, respectively subtracting the weight of each piece of tape from the measured weight, and averaging the two resulting figures. The weight of a toner remaining on a photosensitive member (b) was obtained similarly. The transfer efficiency was obtained by following equation:

$$\text{Transfer efficiency } \eta(\%)=a\times 100/(a+b)$$

"○", "Δ" and "X" shown in Table 3 and Table 4 specifically mean as follows:

Criteria for Assessing Solid Developed Amount

○: Transfer efficiency η is 99% or more.

Δ: Transfer efficiency η is 90% or more and less than 99% .

X: Transfer efficiency η is less than 90% .

(Result of Assessment in Examples 11 to 17 and Comparative Examples 4 to 6)

Developers of Examples 11 to 17 prepared using a toner using a powder, in which two or more kinds of inorganic oxide powders having different volume average primary particle diameters are added and one kind of them has the surface covered with a wax, of the invention, had the better electrification maintaining property, and had the better transferring property also in long term repetitive use, as seen from Tables 3 to 5. In addition, such a temperature range that unfixed offset does not occur (non-offset temperature region) was wide. Therefore, the suitability of oil-less fixation is high.

On the other hand, developers of a toner using a powder, in which two or more kinds of inorganic oxide powders having different volume average primary particle diameters are added, but an inorganic oxide powder having the surface covered with a resin component is not used, had caused fog in long term repetitive use and had the bad electrification maintaining property as in the results of Comparative Example 4. In addition, developers of a toner, in which only inorganic oxide powders having a small particle diameter are added, had the insufficient transferring property from an initial stage, as shown by the result in Comparative Examples 5 and 6. In addition, such a temperature range that fixed offset does not occur (non-offset temperature region) was narrow.

(Results of Assessment in the Case where Image Forming Method was Changed)

The aforementioned Examples 11 to 17 are examples on the premises of the same image forming method using a toner composition (developer) of the invention, and the cases of a different image forming method using a toner composition (developer) of the invention were assessed.

Example 18

Assessment was performed in the same manner as in Example 15 except in that the cleaning blade of the system was removed, an electrostatic brush comprising a fibrous resin having an electrically conductive filler in which carbon black was dispersed was added, and the electrifying apparatus was replaced with a roll electrifying apparatus.

As a result, a clear image was exhibited not only at an initial stage but also after 10,000 images were copied, and no problems with the images arose.

Example 19

Assessment was performed in the same manner as in Example 15 except for replacing the material for surface of transferring belt of the image forming apparatus with PEF, and providing a heating apparatus on the back of this transferring belt so that a toner image on a transferring belt can be transferred and, at the same time, fixed on a recording member.

Thereupon, an external additive composition of four color toners of Example 11 was replaced with an external additive composition of Example 15, to prepare four color toners. A combination of colors was studied, and a clear and high quality image close to that of photography was obtained.

Then, other Examples (Example 20 to 29) will be described as follows.

<Measurement of covering uniformity of inorganic oxide powder>, <measurement of specific gravity of external additive>, <measurement of primary particle diameter of external additive and standard deviation therefor>, <spherical degree>, <measurement of resistance>, <average shape index SF1 ($ML^2/A$)>, <measurement of electrified amount> and <Solid Area Density> are the same as those described above.

An external additive was prepared as follows:

<Preparation of Resin Covered Inorganic Oxide Powder (A)>

3,000 parts by weight of a titanium oxide fine powder (MT-150A (particle shape: rice particulate, BET specific surface area: 67.5 $m^2/g$, volume average primary particle diameter: 20 nm) was placed into an edge runner "MPUV-2 type" (product name, manufactured by Matsumoto Chuzotekkosho K.K.). A methyltriethoxysilane solution in which 50 parts by weight of methyltriethoxysilane (trade name: TSL8123: manufactured by GE Toshiba Silicones) was diluted in 200 parts by weight of ethanol was added to the titanium oxide fine powder while operating the edge runner, and they were mixed and stirred.

Then, 180 parts by weight of a perfluorooctylethyl acrylate-methyl methacrylate copolymer (Tg=72° C., Mw=50,000) was added over 10 minutes while operating the edge runner, mixing and stirring were performed to adhere a perfluorooctylethyl acrylate-methyl methacrylate copolymer on a methyltriethoxysilane covering, and heating treatment at 105° C. for 60 minutes was performed using drying, to obtain a resin covered inorganic oxide powder (A).

The resin-covered inorganic oxide powder (A) had a volume average primary particle diameter of 24 nm, the covered state was observed, and it was found that a covering thickness was in the range of 0.5 to 2.0 nm, and 100% of the surface of a fine powder was covered.

<Preparation of Resin-covered Inorganic Oxide Powder (B)>

3,000 parts by weight of a titanium oxide fine powder MT-150A (particle shape: rice particulate, BET specific surface area: 67.5 $m^2/g$, volume average primary particle diameter: 20 nm) was placed into an edge runner "MPUV-2 type" (product name, manufactured by Matsumoto Chuzotekkosho K.K.). A methyltriethoxysilane solution in which 50 parts by weight of methyltriethoxysilane (trade name: TSL8123: manufactured by GE Toshiba Silicones) was diluted in 200 parts by weight of ethanol was added to the titanium oxide fine powder while operating the edge runner, and they were mixed and stirred.

Then, 120 parts by weight of a linear polyester powder (Tg=62° C., Mn=4,000, Mw=35,000) was added over 10 minutes while operating the edge runner, mixing and stirring were performed to adhere linear polyester on a methyltriethoxysilane covering, and heating treatment at 105° C. for 60 minutes was performed using drying, to obtain a resin covered inorganic oxide powder (B).

The resin-covered inorganic oxide powder (B) had a volume average primary particle diameter of 23 nm, the covered state was observed, and it was found that a covering thickness was in the range of 0.5 to 1.5 nm, and 95% of the surface of a fine powder was covered.

<Preparation of Resin-covered Inorganic Oxide Powder (C)>

1500 parts by weight of a silicone oxide fine powder A200 (particle shape: undefined, BET specific area: 190 $m^2/g$, volume average primary particle diameter: 12 nm) was placed into an edge runner "MPUV-2 type" (product name, manufactured by Matsumoto Chuzotekkosho K.K.). A methyltriethoxysilane solution in which 50 parts by weight of methyltriethoxysilane (trade name: TSL8123: manufactured by GE Toshiba Silicones) was diluted in 200 parts by weight of ethanol was added to the titanium oxide fine powder while operating the edge runner, and they were mixed and stirred.

Then, 100 parts by weight of a linear polyester powder (Tg=46° C., Mn=3.000, Mw=26,000) was added over 10 minutes while operating the edge runner, mixing and stirring were performed to adhere linear polyester on a methyltriethoxysilane covering, and heating treatment at 105° C. for 60 minutes was performed using drying, to obtain a resin covered inorganic oxide powder (C).

The resin-covered inorganic oxide powder (C) had a volume average primary particle diameter of 15 nm, the covered state was observed, and it was found that a covering thickness was in the range of 0.5 to 1.5 nm, and 100% of the surface of a fine powder was covered.

<Preparation of Resin-covered Inorganic Oxide Powder (D)>

3,000 parts by weight of a titanium oxide fine powder TAF-1500 (particle shape: undefined, BET specific area: 55.0 $m^2/g$, volume average primary particle diameter 20 nm, manufactured by Fuji Titanium Industry Co., Ltd.) was placed into an edge runner "MPUV-2 type" (product name, manufactured by Matsumoto Chuzotekkosho K.K.). A methyltriethoxysilane solution in which 50 parts by weight of methyltriethoxysilane (trade name: TSL8123: manufactured by GE Toshiba Silicones) was diluted in 200 parts by weight of ethanol was added to the titanium oxide fine powder while operating the edge runner, and they were mixed and stirred.

Then, 200 parts by weight of a perfluorooctylethyl acrylate-methyl methacrylate copolymer (Tg=43° C., Mw=39,000) was added over 10 minutes while operating the edge runner, mixing and stirring were performed to adhere linear polyester on a methyltriethoxysilane covering, and heating treatment at 105° C. for 60 minutes was performed using drying, to obtain a resin covered inorganic oxide powder (D).

The resin-covered inorganic oxide powder (D) had a volume average primary particle diameter of 25 nm, the covered state was observed, and it was found that a covering thickness was in the range of 1.5 to 2.5 nm, and 100% of the surface of a fine powder was covered. <Preparation of monodisperse spherical silica (A)>, <preparation of monodisperse spherical silica (B)>, (preparation of colorant particle A), (preparation of colorant particle B), <preparation of resin dispersion (1)>, <preparation of resin dispersion (2)>, <preparation of colorant dispersion (1)>, <preparation of colorant dispersion (2)>, <preparation of colorant dispersion (3)>, <preparation of colorant dispersion (4)>, <preparation of releasing agent dispersion>, <preparation of flocculated particle>, <preparation of colorant particle B>, <preparation of colorant particle B Kuro>, <preparation of colorant particle B Cyan>, <preparation of colorant particle B Magenta>, <preparation of colorant particle B Yellow> and <preparation of carrier> are the same as those described above.

Example 20

1 part of a resin-covered inorganic oxide powder (B), and 1.3 parts of hydrophobic silica (RX50, manufactured by Nippon Aerosil Co., Ltd.) having a volume average primary diameter of 40 nm were added to each 100 parts of Kuro, Cyan, Magenta and Yellow toners of the aforementioned colorant particle B, the mixture was blended for 10 minutes using a Henschel mixer at a circumferential speed of 32 m/s, and crude particles were removed using a 45 $\mu$m mesh sieve, to obtain a toner. 100 parts of a carrier and 5 parts of the toner were stirred for 20 minutes at 40 rpm using a V-blender, and classified with a sieve having a 177 $\mu$m mesh to obtain a developer.

Example 21

1 part of a resin-covered inorganic oxide powder (A), and 1.4 parts of hydrophobic silica (RX50, manufactured by Nippon Aerosil Co., Ltd.) having a volume average primary particle diameter of 40 nm were added to 100 parts by of the aforementioned colorant particle B Kuro, the mixture was blended for 10 minutes using a Henschel mixer at a circumferential speed of 32 m/ s, and crude particles were removed using a 45 $\mu$m mesh sieve, to obtain a toner. 100 parts of a carrier and 5 parts of the toner were stirred for 20 minutes at 40 rpm using a V-blender, and classified with a sieve having a 177 $\mu$m mesh to obtain a developer.

Example 22

0.7 part of a resin-covered inorganic oxide powder (C), and 1.5 parts of hydrophobic titanium oxide (TAF-500S, manufactured by Fujititan) having a volume average primary particle diameter of 50 nm were added to 100 parts by of the aforementioned colorant particle B Kuro, the mixture was blended for 10 minutes using a Henschel mixer at a circumferential speed of 32 m/s, and crude particles were removed using a 45 $\mu$m mesh sieve, to obtain a toner. 100 parts of a carrier and 5 parts of the toner were stirred for 20 minutes at 40 rpm using a V-blender, and classified with a sieve having a 177 $\mu$m mesh to obtain a developer.

Example 23

1.3 parts of a resin-covered inorganic oxide powder (D), and 1.2 parts of hydrophobic silica (RX50, manufactured by Nippon Aerosil Co., Ltd.) having a volume average primary particle diameter of 40 nm were added to 100 parts by of the aforementioned colorant particle AKuro, the mixture was blended for 10 minutes using a Henschel mixer at a circumferential speed of 32 m/ s, and crude particles were removed using a 45 $\mu$m mesh sieve, to obtain a toner. 100 parts of a carrier and 5 parts of the toner were stirred for 20 minutes at 40 rpm using a V-blender, and classified with a sieve having a 177 $\mu$m mesh to obtain a developer.

Example 24

2 parts of monodisperse spherical silica (A) was added to 100 parts of the aforementioned colorant particle B Kuro, the mixture was blended for 10 minutes using a Henschel mixer at a circumferential speed of 32 m/s, 1 part of a resin-covered inorganic oxide powder (A) and 1.4 parts of hydrophobic silica (RX50, manufactured by Nippon Aerosil Co., Ltd.) having a volume average primary particle diameter of 40 nm were added, the mixture was blended for 5 minutes at a circumferential speed of 20 m/s, and crude particles were removed using a 45 $\mu$m mesh sieve, to obtain a toner. 100 parts of a carrier and 5 parts of the toner were stirred for 20 minutes at 40 rpm using a V-blender, and classified with a sieve having a 177 $\mu$m mesh to obtain a developer.

Example 25

1.5 parts of monodisperse spherical silica (B) was added to 100 parts of the aforementioned colorant particle B Kuro, the mixture was blended for 10 minutes using a Henschel mixer at a circumferential speed of 32 m/s, 1 part of a resin-covered inorganic oxide powder (A) and 1.4 parts of hydrophobic silica (RX50, manufactured by Nippon Aerosil Co., Ltd.) having a volume average primary particle diameter of 40 nm were added, the mixture was blended for 5 minutes at a circumferential speed of 20 m/s, and crude particles were removed using a 45 $\mu$m mesh sieve, to obtain a toner. 100 parts of a carrier and 5 parts of the toner were stirred for 20 minutes at 40 rpm using a V-blender, and classified with a sieve having a 177 $\mu$m mesh to obtain a developer.

Example 26

2 parts of monodisperse spherical silica (A), 1 part of a resin-covered inorganic oxide powder (A) and 1.4 parts of hydrophobic silica (RX50, manufactured by Nippon Aerosil Co., Ltd.) having a volume average primary particle diameter of 40 nm were added to 100 parts of the aforementioned colorant particle B Kuro, the mixture was blended for 10 minutes using a Henschel mixer at a circumferential speed of 32 m/s, and crude particles were removed using a 45 μm mesh sieve, to obtain a toner. 100 parts of a carrier and 5 parts of the toner were stirred for 20 minutes at 40 rpm using a V-blender, and classified with a sieve having a 177 μm mesh to obtain a developer.

Comparative Example 7

0.7 part of a fine powder obtained by treating a titanium oxide fine powder MT-150A (particle shape: rice particulate, BET specific surface area: 67.5 $m^2/g$, volume average primary particle diameter: 20 nm) with 10% decyltrimethoxysilane, and 1.2 parts of hydrophobic silica (RX50, manufactured by Nippon Aerosil Co., Ltd.) having a volume average primary particle diameter of 40 nm were added to 100 parts of the aforementioned colorant particle B Kuro, the mixture was blended for 10 minutes using a Henschel mixer at a circumferential speed of 32 m/s, and crude particles were removed using 45 μm mesh sieve, to obtain a toner. 100 parts of a carrier and 5 parts of the toner were stirred for 20 minutes at 40 rpm using a V-blender, and classified with a sieve having a 177 Vim mesh to obtain a developer.

Comparative Example 8

A developer was obtained in the same manner as in Example 21 except in that the hydrophobic silica (RX50, manufactured by Nippon Aerosil Co., Ltd.) having a volume average primary particle diameter of 40 nm was omitted.

Comparative Example 9

A developer was obtained in the same manner as in Example 21 except in that the 1 part of the resin-covered inorganic oxide powder (A) was replaced with 1.2 parts of hydrophobic silica (R812, manufactured by Nippon Aerosil Co., Ltd.) having an average particle diameter of 8 nm.

Using developers described in the aforementioned Examples and Comparative Examples, the developing property and the transferring property at an initial stage and after 20,000 images were copied were assessed by using modified Docu Centre Color 400 cp manufactured by Fuji Xerox Co., Ltd. of a tandem system.

<Assessment of Developing Property>

For assessing the developing property, a developer having a toner concentration of 5% by weight was respectively allowed to stand under the conditions of a temperature of 29° C. and a humidity of 90% , and a temperature of 10° C. and a humidity of 20% , an image having a 2 cm×5 cm patch at each of two places was copied, and a developed amount at hard stop was measured.

A developed amount was obtained by respectively transferring developed parts of the two places on a photosensitive member onto a piece of tape by utilizing the adhesiveness thereof, measuring the weight of each piece of tape with toner adhered thereto, respectively subtracting the weight of each piece of tape, and averaging the two resulting figures (aiming at 4.0 $g/m^2$ to 5.0 $g/m^2$).

Determination was performed by designating values within the aimed range as ○ and designating values outside of the range as X.

Fog was determined by similarly transferring a background part onto a piece of tape, counting the number of toner particles per 1 $cm^2$, designating values of 100 or less as ○, designating values 100 to 500 as Δ and designating values of greater than 500 as X.

<Assessment of Transferring Property>

For assessing transferring property, hard stop was performed at completion of a transferring step, an amount of a transferred toner (a) was obtained by transferring weight of toner on an intermediate transferring member of two places on a piece of tape as described above, measuring the weight of each piece of tape with a toner adhered thereto, subtracting the weight of each piece of tape from the measured weight, and averaging the two resulting figures. An amount of a toner remaining on a photosensitive member (b) was measured similarly. The transfer efficiency η was obtained by the following equation:

$$\text{Transfer efficiency } \eta(\%)=a\times 100/(a+b)$$

The transfer efficiency η≧99% is aimed, and determination was performed as follows:

| | |
|---|---|
| $\eta \geqq 99\%$ | ○ |
| $90\% \geqq \eta < 99\%$ | Δ |
| $\eta < 90\%$ | X |

The aforementioned results are shown in Table 6 (initial stage) and Table 7 (after 20,000 images were printed).

TABLE 6

| | Electrifying property (−μC/g) | | Developing property: Developed amount (toner concentration 5% by weight: $g/m^2$) | | | | Developing property: Fogged toner (Grade) | | | | Transferring property (Transfer efficiency) | | | |
|---|---|---|---|---|---|---|---|---|---|---|---|---|---|---|
| | Temperature and humidity = 29° C. 90% | Temperature and humidity = 10° C. 20% | Temperature and humidity = 29° C. 90% | | Temperature and humidity = 10° C. 20% | | Temperature and humidity = 29° C. 90% | | Temperature and humidity = 10° C. 20% | | Temperature and humidity = 29° C. 90% | | Temperature and humidity = 10° C. 20% | |
| Example 20 | | | | | | | | | | | | | | |
| Kuro | 33 | 40 | 4.6 | ○ | 4.3 | ○ | 50 | ○ | 35 | ○ | 95.3 | Δ | 97.3 | Δ |
| Cyan | 38 | 42 | 4.3 | ○ | 4.1 | ○ | 60 | ○ | 20 | ○ | 95.6 | Δ | 96.8 | Δ |
| Magenta | 35 | 38 | 4.7 | ○ | 4.5 | ○ | 45 | ○ | 35 | ○ | 93.2 | Δ | 96.7 | Δ |
| Yellow | 41 | 44 | 4.3 | ○ | 4.2 | ○ | 53 | ○ | 45 | ○ | 96.5 | Δ | 98.9 | Δ |

TABLE 6-continued

| | Electrifying property (−μC/g) | | Developing property: Developed amount (toner concentration 5% by weight: g/m²) | | | | Developing property: Fogged toner (Grade) | | | | Transferring property (Transfer efficiency) | | | |
|---|---|---|---|---|---|---|---|---|---|---|---|---|---|---|
| | Temperature and humidity = 29° C. 90% | Temperature and humidity = 10° C. 20% | Temperature and humidity = 29° C. 90% | | Temperature and humidity = 10° C. 20% | | Temperature and humidity = 29° C. 90% | | Temperature and humidity = 10° C. 20% | | Temperature and humidity = 29° C. 90% | | Temperature and humidity = 10° C. 20% | |
| Example 21 | 35 | 41 | 4.5 | ○ | 4.2 | ○ | 50 | ○ | 45 | ○ | 96.8 | Δ | 97.8 | Δ |
| Example 22 | 31 | 34 | 4.8 | ○ | 4.8 | ○ | 85 | ○ | 70 | ○ | 96.3 | Δ | 98.0 | Δ |
| Example 23 | 35 | 42 | 4.5 | ○ | 4.2 | ○ | 63 | ○ | 45 | ○ | 92.8 | Δ | 95.8 | Δ |
| Example 24 | 36 | 42 | 4.3 | ○ | 4.1 | ○ | 65 | ○ | 53 | ○ | 99.1 | ○ | 99.8 | ○ |
| Example 25 | 35 | 43 | 4.3 | ○ | 4.2 | ○ | 82 | ○ | 95 | ○ | 99.8 | ○ | 99.9 | ○ |
| Example 26 | 36 | 40 | 4.3 | ○ | 4.3 | ○ | 110 | Δ | 120 | Δ | 99.2 | ○ | 99.3 | ○ |
| Comparative Example 7 | 30 | 42 | 4.8 | ○ | 4.0 | ○ | 115 | Δ | 65 | ○ | 93.8 | Δ | 95.3 | Δ |
| Comparative Example 8 | 31 | 35 | 4.5 | ○ | 4.7 | ○ | 55 | ○ | 46 | ○ | 88.3 | X | 93.6 | Δ |
| Comparative Example 9 | 30 | 40 | 4.8 | ○ | 4.2 | ○ | 68 | ○ | 75 | ○ | 89.5 | X | 94.0 | Δ |

TABLE 7

| | Electrifying property (−μC/g) | | Developing property: Solid developed amount (g/m²) | | | | Developing property: Fogged toner (Grade) | | | | Transferring property (Transfer efficiency) | | | |
|---|---|---|---|---|---|---|---|---|---|---|---|---|---|---|
| | Temperature and humidity = 29° C. 90% | Temperature and humidity = 10° C. 20% | Temperature and humidity = 29° C. 90% | | Temperature and humidity = 10° C. 20% | | Temperature and humidity = 29° C. 90% | | Temperature and humidity = 10° C. 20% | | Temperature and humidity = 29° C. 90% | | Temperature and humidity = 10° C. 20% | |
| Example 20 | | | | | | | | | | | | | | |
| Kuro | 30 | 40 | 4.7 | ○ | 4.3 | ○ | 86 | ○ | 45 | ○ | 92.4 | Δ | 96.8 | Δ |
| Cyan | 35 | 38 | 4.5 | ○ | 4.5 | ○ | 65 | ○ | 60 | ○ | 91.6 | Δ | 96.5 | Δ |
| Magenta | 33 | 36 | 4.6 | ○ | 4.5 | ○ | 70 | ○ | 65 | ○ | 90.2 | Δ | 95.4 | Δ |
| Yellow | 40 | 42 | 4.2 | ○ | 4.2 | ○ | 50 | ○ | 35 | ○ | 93.6 | Δ | 96.7 | Δ |
| Example 21 | 33 | 38 | 4.6 | ○ | 4.3 | ○ | 88 | ○ | 58 | ○ | 92.6 | Δ | 96.5 | Δ |
| Example 22 | 29 | 33 | 4.8 | ○ | 4.7 | ○ | 115 | Δ | 100 | ○ | 92.5 | Δ | 96.0 | Δ |
| Example 23 | 33 | 41 | 4.5 | ○ | 4.4 | ○ | 125 | Δ | 55 | ○ | 90.0 | Δ | 93.0 | Δ |
| Example 24 | 33 | 40 | 4.4 | ○ | 4.2 | ○ | 130 | Δ | 95 | ○ | 99.0 | ○ | 99.5 | ○ |
| Example 25 | 32 | 40 | 4.5 | ○ | 4.2 | ○ | 100 | Δ | 90 | ○ | 99.5 | ○ | 99.0 | ○ |
| Example 26 | 32 | 43 | 4.5 | ○ | 4.0 | ○ | 230 | Δ | 320 | Δ | 97.5 | Δ | 99.6 | ○ |
| Comparative Example 7 | 22 | 30 | 5.5 | X | 5.0 | ○ | 562 | X | 583 | X | 90.5 | Δ | 94.6 | Δ |
| Comparative Example 8 | 26 | 31 | 5.0 | ○ | 5.0 | ○ | 149 | Δ | 113 | Δ | 73.6 | X | 76.5 | X |
| Comparative Example 9 | 27 | 34 | 5.0 | ○ | 4.8 | ○ | 185 | Δ | 145 | Δ | 73.2 | X | 79.0 | X |

Developers of a toner using a powder, in which two or more kinds of inorganic oxide powders having different volume average primary particle diameters are added, and one of them has the surface covered with a resin component, had the better electrifying property, and had the better transferring property in long term repetitive use, as the results of Examples 20 to 26.

On the other hand, a developer of a toner, in which two more inorganic oxide powders having different volume average primary particle diameters are added, but an inorganic oxide powder having the surface covered with a resin component is not used, caused fog and had the bad electrifying property in long term use, as the result of Comparative Example 7. In addition, a developer of a toner, in which only inorganic oxide powders having a small particle diameter are added, had the insufficient transferring property from an initial stage, as the results of Comparative Examples 8 and 9.

Example 27

The developing property and the transferring property were assessed using the black toner of Example 24 in the same manner as in Example 24 except in that the cleaning blade of the system was omitted, an electrostatic brush comprising a fibrous resin having an electrically conductive filler in which carbon black was dispersed was added, and the electrifying apparatus was replaced with a roll electrifying apparatus.

As a result, a clear image was exhibited not only at an initial stage but also after 10,000 images were copied, and no problems with the images arose.

Example 28

Recovery was performed in a developing apparatus in the same manner as in Example 24 except in that blade and brush cleaning of the system were not carried out at all, and the electrifier was replaced with a Scotron electrifier.

As a result, a clear image was exhibited not only at an initial stage but also after 10,000 images were copied, and no problems with the images arose.

Example 29

Transference and fixation were performed simultaneously in the same manner as in Example 24 except in that the material for the surface of the transferring belt of the system was replaced with PFA, and an apparatus for heating from a rear surface was added.

By replacing an external additive composition for four color toners of Example 20 with an external additive composition of Example 24, and combining colors, a clear and high quality image close to that of photography was obtained.

As explained above, according to the invention, there is provided an electrostatic image dry toner composition, a developer for developing electrostatic latent images and an image forming method, which can satisfy the toner flowability, electrifying property, developing property, transferring property, cleaning property and fixing property at the same time and over long term, can prevent a flaw of a latent image holding member from occurring, in particular, has not a blade cleaning step promoting abrasion of a latent image holding member, and improves the problem of recovery of a transference residue toner at the same time with development, or recovery of a toner remaining on a latent image holding member using an electrostatic brush.

Further, there is provided an image forming method that can perform development, transference, fixation and oil-less fixation responding to the high image quality requirement.

What is claimed is:

1. An electrostatic image dry toner composition comprising a binding resin, a colorant, a releasing agent, and two or more kinds of inorganic oxide powders having different volume average primary particle diameters, wherein a surface of at least one kind of the inorganic oxide powders is covered with a coating material selected from the group of 1) a fatty acid metal salt, 2) a wax having a melting point of 40° C. or higher, and 3) a resin having a glass transition temperature of 40° C. or higher, wherein the surface of the inorganic oxide powder that is covered with the coating material is covered therewith at a thickness of 0.5 to 5 nm.

2. An electrostatic image dry toner composition according to claim 1, wherein a volume average primary particle diameter of one of the two or more kinds of inorganic oxide powders having different volume average primary particle diameters is 5 nm or more and less than 30 nm, and a volume average primary particle diameter of another of the two or more kinds of inorganic oxide powders is 30 nm or more and 70 nm or less.

3. An electrostatic image dry toner composition according to claim 1, wherein the surface of the inorganic oxide powder that is covered with the coating material is covered with at least one of alkoxysilane and polysiloxane, and further covered with the coating material.

4. An electrostatic image dry toner composition according to claim 3, wherein the surface of the inorganic oxide powder that is covered with the coating material is at least covered with an organosilane compound produced from alkoxysilane.

5. An electrostatic image dry toner composition according to claim 1, wherein at least one kind of the two or more inorganic oxide powders having different volume average primary particle diameters is spherical silica having a specific gravity in a range of 1.2 to 1.9 and a volume average primary particle diameter in a range of 80 to 300 nm.

6. A developer for developing electrostatic latent images, the developer comprising:

a carrier having, on a surface of a core material, a resin-coating layer in which an electrically conductive material is dispersed in a matrix resin; and a toner composition containing a binding resin, a colorant, a releasing agent, two or more kinds of inorganic oxide powders having different volume average primary particle diameters, wherein a surface of at least one kind of the inorganic oxide powders is covered with a coating material selected from the group of 1) a fatty acid metal salt, 2) a wax having a melting point of 40° C. or higher, and 3) a resin having a glass transition temperature of 40° C. or higher, and wherein the surface of the inorganic oxide powder that is covered with the coating material is covered therewith at a thickness of 0.5 to 5 nm.

7. A developer for developing electrostatic latent images according to claim 6, wherein a volume average primary particle diameter of one of the two or more kinds of inorganic oxide powders having different volume average primary particle diameters is 5 nm or more and less than 30 nm, and a volume average primary particle diameter of another of the two or more kinds of inorganic oxide powders is 30 mn or more and 70 mn or less.

8. An image forming method of forming an image using an image forming apparatus comprising electrifying means for uniformly electrifying a latent image holding member, latent image forming means for exposing a surface of the electrified latent image holding member with light to form an electrostatic latent image, developing means for developing the electrostatic latent image into a toner image using a toner composition, transferring means for transferring the formed toner image onto a recording member, and fixing means for fixing the transferred toner image onto a surface of the recording member, wherein the toner composition comprises a binding resin, a colorant, a releasing agent, and two or more kinds of inorganic oxide powders having different volume average primary particle diameters, and a surface of at least one kind of the inorganic oxide powders is covered with a coating material selected from the group of 1) a fatty acid metal salt, 2) a wax having a melting point of 40° C. or higher, and 3) a resin having a glass transition temperature of 40° C. or higher, and wherein the surface of the inorganic oxide powder that is covered with the coating material is covered therewith at a thickness of 0.5 to 5 mm.

9. An image forming method according to claim 8, wherein the developing means develops respective color toners on the latent image holding member, and the transferring means transfers formed color toner images onto an intermediate transferring member and, thereafter, transfers the respective color toner images onto the recording member at once.

10. An image forming method according to claim 8, wherein the fixing means does not substantially supply a releasing oil.

11. An image forming method of forming an image using an image forming apparatus comprising electrifying means for uniformly electrifying a latent image holding member, latent image forming means for exposing a surface of the electrified latent image holding member with light to form an electrostatic latent image, developing means for developing the electrostatic latent image into a toner image using a toner composition, transferring means for transferring the formed toner image onto a recording member, cleaning means for removing toner remaining on the surface of the latent image holding member after transference, and fixing means for fixing the transferred toner image onto a surface of the recording member, wherein the toner composition comprises a binding resin, a colorant, a releasing agent, and two or more kinds of inorganic oxide powders having different volume average primary particle diameters, and a surface of at least one kind of the inorganic oxide powders is covered with a coating material selected from the group of 1) a fatty acid metal salt, 2) a wax having a melting point of 40° C. or higher, and 3) a resin having a glass, transition temperature of 40° C. or higher, and wherein the surface of the inorganic oxide powder that is covered with the coating material is covered therewith at a thickness of 0.5 to 5 nm.

12. An image forming method according to claim 11, wherein the cleaning means recovers the toner remaining on the surface of the latent image holding member using an electrostatic brush.

13. An image forming method according to claim 11, wherein the cleaning means recovers the toner remaining on the surface of the latent image holding member using a developing apparatus.

14. An image forming method according to claim 11, wherein an average shape index SF1 ($ML^2/A$) of toner particles of the toner composition is in a range of 100 to 140.

15. An image forming method of forming an image using an image forming apparatus comprising electrifying means for uniformly electrifying a latent image holding member, latent image forming means for exposing a surface of the electrified latent image holding member with light to form an electrostatic latent image, developing means for developing the electrostatic latent image into a toner image using a toner composition, and transferring and fixing means for transferring the formed toner image onto an intermediate transferring member, and transferring and fixing the toner image onto a recording member at the same time, wherein the toner composition comprises a binding resin, a colorant, a releasing agent, two or more kinds of inorganic oxide powders having different volume average primary particle diameters, and a surface of at least one kind of the inorganic oxide powders is covered with a coating material selected from the group of 1) a fatty acid metal salt, 2) a wax having a melting point of 40° C. or higher, and 3) a resin having a glass transition temperature of 40° C. or higher, and the developing means develops respective color toners on the latent image holding member, and the transferring and fixing means transfers formed color toner images onto an intermediate transferring member and, thereafter, transfers the respective color toner images onto the recording member at once and simultaneously fixes the respective color toner images on the recording member, and wherein the surface of the inorganic oxide powder that is covered with the coating material is covered therewith at a thickness of 0.5 to 5 nm.

* * * * *